US012187492B2

(12) United States Patent
Schein

(10) Patent No.: US 12,187,492 B2
(45) Date of Patent: Jan. 7, 2025

(54) FABRIC SECURITY BAG

(71) Applicant: Gary Schein, Camarillo, CA (US)

(72) Inventor: Gary Schein, Camarillo, CA (US)

( * ) Notice: Subject to any disclaimer, the term of this patent is extended or adjusted under 35 U.S.C. 154(b) by 0 days.

(21) Appl. No.: 17/368,714

(22) Filed: Jul. 6, 2021

(65) Prior Publication Data

US 2022/0009674 A1 Jan. 13, 2022

Related U.S. Application Data

(60) Provisional application No. 63/048,754, filed on Jul. 7, 2020.

(51) Int. Cl.
*B65D 30/08* (2006.01)
*B65D 33/28* (2006.01)

(52) U.S. Cl.
CPC ..... *B65D 29/02* (2013.01); *B65D 33/28* (2013.01)

(58) Field of Classification Search
CPC ..... B65D 29/02
See application file for complete search history.

(56) References Cited

U.S. PATENT DOCUMENTS 3,653,583 A * 4/1972 Meyer ..... B65D 33/12 383/26
5,069,554 A * 12/1991 Bonnett ..... A47G 11/003 53/413
5,473,917 A 12/1995 Say
6,408,660 B1 6/2002 Lai
6,818,091 B1 * 11/2004 Holland ..... B32B 27/32 156/192
8,839,650 B2 9/2014 Zuraski
9,206,627 B2 12/2015 Lin
9,234,371 B2 1/2016 Conti et al.
9,986,808 B2 * 6/2018 Halpern ..... A45C 13/1046
10,006,227 B1 6/2018 Szebeni
10,066,326 B2 9/2018 Ji et al.
10,258,125 B1 * 4/2019 Cohen ..... B32B 3/08
10,450,775 B2 10/2019 Cagan
2009/0266722 A1 * 10/2009 Rogers ..... B65D 81/1275 206/521
2010/0002962 A1 * 1/2010 Tatsuno ..... A47G 9/086 383/85

(Continued)

FOREIGN PATENT DOCUMENTS

JP 05077880 * 3/1993 ..... B65D 88/22
WO 2019006542 A1 1/2019

*Primary Examiner* — Derek J Battisti
(74) *Attorney, Agent, or Firm* — LYON & HARR, LLP; Richard T. Lyon

(57) ABSTRACT

A fabric security bag having a fabric closable draw string configuration is provided. In general, the fabric security bag includes a fabric envelope surrounding the fabric security bag chamber; a closeable opening at the top of the fabric envelope open to the chamber; and at least one longitudinal cable channel housing with a cable channel running longitudinally completely around the periphery of the closeable opening. The cable channel housing is secured to the top of the fabric envelope and has entries into the cable channel at each end of the longitudinal cable channel housing. The cable channel housing has a longitudinal fabric wall along its full length with a series of voids separated by fabric portions to reduce the amount of fabric enclosing the cable channel.

3 Claims, 20 Drawing Sheets

(56) References Cited

U.S. PATENT DOCUMENTS

| | | | | |
|---|---|---|---|---|
| 2010/0027921 | A1* | 2/2010 | Thomson | E05B 65/52 70/64 |
| 2011/0136401 | A1 | 6/2011 | Hanusa et al. | |
| 2013/0051709 | A1* | 2/2013 | Roether | A43B 23/0245 383/117 |
| 2016/0209179 | A1 | 7/2016 | Abdulghaffar | |
| 2017/0368784 | A1 | 12/2017 | Konyu et al. | |
| 2018/0255893 | A1* | 9/2018 | Godshaw | A45C 3/06 |
| 2019/0240952 | A1 | 8/2019 | Bhatnagar et al. | |
| 2019/0375202 | A1 | 12/2019 | Singletary | |

* cited by examiner

FABRIC SECURITY BAG

CROSS REFERENCE TO RELATED APPLICATION

This application claims the benefit of and priority to provisional U.S. patent application Ser. No. 63/048,754 filed Jul. 7, 2020.

BACKGROUND

Security has been an issue almost since man has come into this world. Man has responded by inventing lockable storage containers, lockable storage rooms, office safes, walk-in bank safes, lockable vehicles optionally with lockable trunks, and the like. Such lockable storage containers, rooms, etc., have proven their worth and stood the test of time. Some are expensive, some are cumbersome to move, some take up a relatively large amount of floor space, and most often they are not attractive.

In recent years more and more purchases are being made online and the purchased items are delivered directly to the purchaser's apartment, home or office. If there is no one at the apartment, home or office to accept the purchased item at the time of delivery, the purchased item, which is normally boxed or sealed in a paper or a plastic envelope, is left at the front or main door of the apartment, home or the delivery door of the office if the office has a delivery door by the delivery service. Unfortunately, theft of purchased items left at the front, main or delivery door is becoming more and more common. There are thieves who reconnoiter residential areas, apartment complexes or office buildings looking for packages left at the front door or main door. Those thieves that hit apartment complexes and office buildings are usually on foot, although they may have an associate[s] in a vehicle to accept the purloined package[s] and secret them away. The associate[s] with the vehicle also provide a means of escape for the primary thief in the event of discovery. For residential areas, some of the thieves are on foot and have an associate[s] with a vehicle. The thief grabs the item from the front door area, runs to the street and drops the package into the vehicle of his or her associate to secret the package. Again, the associate[s] and vehicle provides a means of escape in the event of discovery of the primary thief. Other thieves work from a vehicle and patrol the residential area. When they see a package dropped off the front door, the associate exits the vehicles, picks up the package and returns to the vehicle with the package. The vehicle with all parties and the purloined package then drives off.

Some homes and offices have installed a lockable box near the front, main or delivery door which is unlocked to receive deliveries and is locked by the delivery person. Some of the lockable boxes have an open lid or door that automatically locks when the lid or door is closed. Other boxes are provided with an open padlock secured to the box by chain which can be used by the delivery person to lock the box when the purchased item is placed in the box and the box lid or door closed. The box lid or door is fitted with the classical hardware used to lock a door with a padlock.

Often the use of such lockable boxes is not practical or desirable. There may not be sufficient room to locate such a box near the front, main or delivery door. It may not be possible to secure the lockable box to the home or office to prevent theft of the box. It is rare to have a lockable box situated near an apartment in an apartment complex because it can partially obstruct the hallway in front of the apartment door. Finally a lockable box located near the front door or main door of a home can be an eye sore and/or an invitation for a thief.

Ideally what is needed is a secure storage device for online or telephone purchased items that can receive the purchased items, be easily (1) closed to prevent theft, (2) locked by the delivery person, (3) moved and/or put away or out of sight when not in use, and (4) secured to the apartment, home or office or the door thereof.

There are other needs or activities that would benefit if a light weight, moveable secure storage device was available. For example, bicycling, hiking and camping are popular recreational activities. Frequently the bicyclist, hiker and/or camper will carry supplies and equipment in a backpack. The backpack frequently will hold the purse, wallet, cell phone, computer pad, passport, medicines and the like of the owner of the backpack. Frequently during the bike ride, or hike and/or when camping, it is desirable to take off the backpack for a rest break, a meal or for demands of nature. Because of this the owner of the backpack will normally keep the backpack in sight to prevent its theft or penetration. Even securing the backpack to a pole or fence or bike will not protect the contents of the conventional fabric security bag since a sharp knife can easily cut through the fabric of the conventional backpack giving one access to the contents of the backpack.

Students of all ages and grades and college students use back packs to carry books, supplies and equipment to and from school. As in the case to the reactional backpack user described above, the student's backpack, depending upon the sex, age and grade and/or school level, can contain the student's lunch money, the student's purse, wallet, cell phone, computer pad and the like.

SUMMARY

The fabric security bag implementations described herein generally involve a heavy laminated fabric closable draw string bag. In one implementation, the fabric security bag includes a front panel and back panel that are joined along a first edge, which is adjacent to a closable open end of the fabric security bag. The front and back panels are also joined along a second edge that is adjacent to the open end and opposite the first edge. And further, the front and back panels are joined along a closed end that is opposite the closable open end of the fabric security bag. The front panel and back panel are made from a fabric laminate having at least one layer of cut-resistant fabric forming an internal wall of the fabric security bag and at least one layer of a protective fabric that is lighter than the cut-resistant fabric and which forms an exterior wall of the fabric security bag. The closable open end of the fabric security bag includes a first cable channel housing forming a first cable channel along an edge of the front panel at the open end of the fabric security bag. The closable open end also includes a second cable channel housing forming a second cable channel along an edge of the back panel at the open end of the fabric security bag. At least a first cable is also included, a portion of which is threaded through the first cable channel and another portion of which is threaded through the second cable channel. The first and second end portions of the first cable extend out of the first and second cable channels, respectively, on the same side of the closable open end of the fabric security bag. The first cable is slidable within the first and second cable channel housings that form the first and second cable channels. In addition, whenever both ends portions of the first cable are drawn out of the first and second cable channels at the same time, the fabric laminate forming the first and second cable housing of the closable open end of the fabric security bag collapses in a manner that reduces the size of the open end and closes the fabric security bag. This secures items placed inside the fabric security bag that are larger than the closed open end from exiting the fabric security bag.

In another implementation, the fabric security bag includes a front panel and back panel that are joined along a first edge, which is adjacent to a closable open end of the fabric security bag. The front and back panels are also joined along a second edge that is adjacent to the open end and opposite the first edge. And further, the front and back panels are joined along a closed end that is opposite the closable open end of the fabric security bag. The front panel and back panel are made from a fabric laminate having at least one layer of cut-resistant fabric forming an internal wall of the fabric security bag and at least one layer of a protective fabric that is lighter than the cut-resistant fabric and which forms an exterior wall of the fabric security bag. The closable open end of the fabric security bag includes a first cable channel housing forming a first cable channel along an edge of the front panel at the open end of the fabric security bag and a second cable channel housing forming a second cable channel along an edge of the back panel at the open end of the fabric security bag. The first and second cable channel housings are made from a fabric laminate having at least one layer of cut-resistant fabric forming an internal wall of the housings and at least one layer of a protective fabric that is lighter than the cut-resistant fabric and which forms at least an exterior wall of the housings, and wherein the at least one layer of cut-resistant fabric forming an internal wall of the housings includes cut-out sections where the cut resistant fabric has been removed to form a tooth pattern along the housings to reduce the amount of fabric making up the housings. There is also at least a first cable, a portion of which is threaded through the first cable channel and another portion of which is threaded through the second cable channel. The first and second end portions of the first cable extend out of the first and second cable channels, respectively, on the same side of the closable open end of the fabric security bag. The first cable is slidable within the first and second cable channel housings that form the first and second cable channels. Further, whenever both ends portions of the first cable are drawn out of the first and second cable channels at the same time, the fabric laminate forming the first and second cable housing of the closable open end of the fabric security bag collapses in a manner facilitated by the cut-out sections in the first and second cable channel housings to reduce the size of the open end and close the fabric security bag. This secures items placed inside the fabric security bag that are larger than the closed open end from exiting the fabric security bag.

In yet another implementation, the fabric security bag includes a front panel and back panel that are joined along a first edge, which is adjacent to a closable open end of the fabric security bag. The front and back panels are also joined along a second edge that is adjacent to the open end and opposite the first edge. And further, the front and back panels are joined along a closed end that is opposite the closable open end of the fabric security bag. This structure forms a cut-resistant portion of the fabric security bag. The front panel and back panel of the cut-resistant portion of the fabric security bag are made from a fabric laminate having two layers of cut-resistant fabric forming an intermediate wall of the fabric security bag, a layer of a protective fabric that is lighter than the cut-resistant fabric and which forms an exterior wall of the fabric security bag, and a layer of a protective fabric that is lighter than the cut-resistant fabric and which forms an interior wall of the fabric security bag. The closable open end of the fabric security bag includes a first cable channel housing forming a first cable channel along an edge of the front panel of the cut-resistant portion of the fabric security bag at the open end thereof and a second cable channel housing forming a second cable channel along an edge of the back panel of the cut-resistant portion of the fabric security bag at the open end thereof. The first and second cable channel housings are made from a fabric laminate having a layer of cut-resistant fabric forming an inner wall of the housings and a layer of a protective fabric that is lighter than the cut-resistant fabric and which forms an exterior wall of the housings. The layer of cut-resistant fabric forming the inner wall of the housings includes cut-out sections where the cut resistant fabric has been removed to form a tooth pattern along the housings to reduce the amount of fabric making up the housings. There is a first cable, a portion of which is threaded through the first cable channel and another portion of which is threaded through the second cable channel. The first and second end portions of the first cable extend out of the first and second cable channels, respectively, on the same side of the closable open end of the fabric security bag. The first cable is slidable within the first and second cable channel housings that form the first and second cable channels. There is also a second cable, a portion of which is threaded through the first cable channel and another portion of which is threaded through the second cable channel. The first and second end portions of the second cable extend out of the first and second cable channels, respectively, on the same side of the closable open end of the fabric security bag which is opposite the side of the closable open end that the first and second end portions of the first cable extend out of the first and second cable channels. The second cable is also slidable within the first and second cable channel housings that form the first and second cable channels. Further, whenever both ends portions of the first and second cables are drawn out of the first and second cable channels at the same time, the fabric laminate forming the first and second cable housing of the closable open end of the fabric security bag collapses in a manner facilitated by the cut-out sections in the first and second cable channel housings to reduce the size of the open end and close the fabric security bag. This secures items placed inside the fabric security bag that are larger than the closed open end from exiting the fabric security bag.

In yet another implementation, the fabric security bag includes one or more quadrilateral panels. Each of these panels is joined along its edges that are adjacent to a closable open end of the fabric security bag if there is just one panel, or to an edge that is adjacent to a closable open end of the fabric security bag of an adjacent panel if there are more than one panels. Each of the panels is also joined at an end opposite the closable open end to an end panel of the fabric security bag. The quadrilateral panels and end panel are made from a fabric laminate having at least one layer of cut-resistant fabric forming an internal wall of the fabric security bag and at least one layer of a protective fabric that is lighter than the cut-resistant fabric and which forms an exterior wall of the fabric security bag. The closable open end of the fabric security bag includes, for each quadrilateral panel, a cable channel housing forming a cable channel along an edge of the panel at the open end of the fabric security bag. The cable channel housing of each quadrilateral panel is made from a fabric laminate having at least one layer of cut-resistant fabric forming an internal wall of the housing and at least one layer of a protective fabric that is lighter than the cut-resistant fabric and which forms an exterior wall of the housing. The at least one layer of cut-resistant fabric forming an internal wall of the housings includes cut-out sections where the cut resistant fabric has been removed to form a tooth pattern along the housings to reduce the amount of fabric making up the housings. The fabric security bag also includes one or more cables, a portion of each cable being threaded through at least one of the cable channels and first and second end portions of the cable respectively extending out of different ends of the same cable channel or extending out of an end of different cable channels. Each cable is slidable within the cable channel housing or housings it is threaded through. Further, whenever the ends portions of each cable are drawn out of the cable channel or channels the cable is threaded through, the fabric laminate forming the cable channel housings of the closable open end of the fabric security bag collapses in a manner that reduces the size of the open end and closes the fabric security bag. This secures items place inside the fabric security bag that are larger than the closed open end from exiting the fabric security bag.

The foregoing Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more detailed description that is presented below.

DESCRIPTION OF THE DRAWINGS

The specific features, aspects, and advantages of the tuning apparatus implementations described herein will become better understood with regard to the following description, appended claims, and accompanying drawings where:

DETAILED DESCRIPTION

Figure 1:
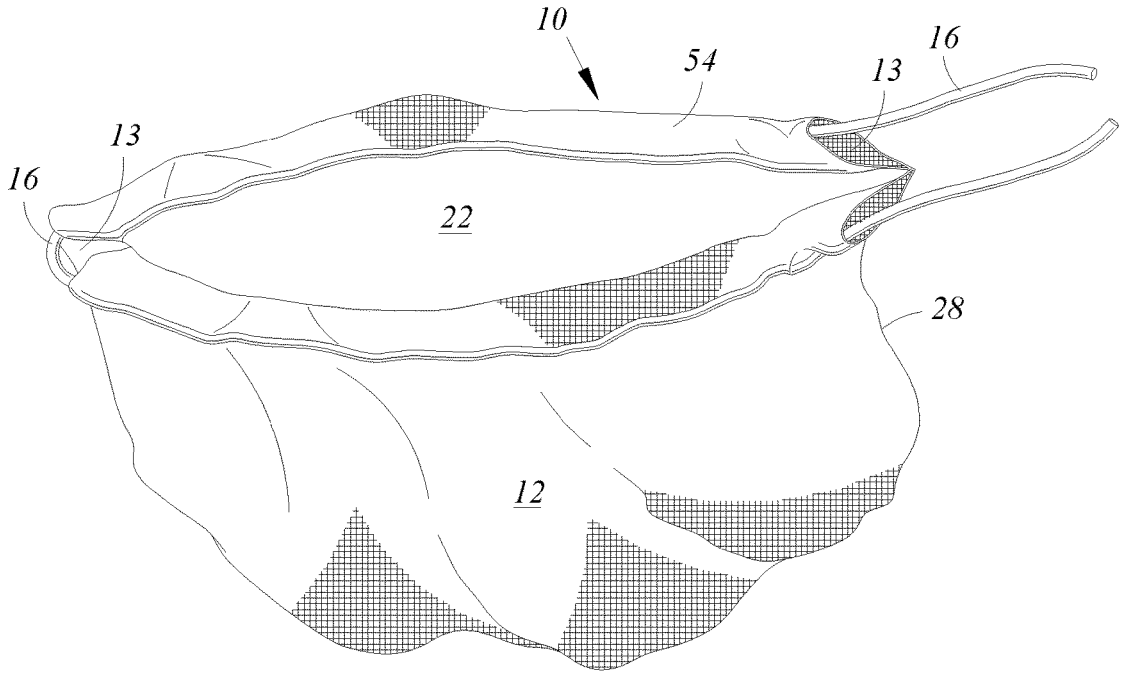
FIG. 1 is a perspective view of a side portion of an exemplary implementation of a fabric security bag.

In the following description of the fabric security bag implementations described herein reference is made to the accompanying drawings which form a part hereof, and in which are shown, by way of illustration, specific implementations in which the fabric security bag can be practiced. It is understood that other implementations can be utilized and structural changes can be made without departing from the scope of the fabric security bag.

It is also noted that for the sake of clarity specific terminology will be resorted to in describing the fabric security bag implementations and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation" means that a particular feature, a particular structure, or particular characteristics described in connection with the implementation or implementation can be included in at least one implementation of the fabric security bag. The appearances of the phrases "in one implementation", "in another implementation", "in an exemplary implementation", "in an alternate implementation", "in one implementation", "in another implementation", "in an exemplary implementation", and "in an alternate implementation" in various places in the specification are not necessarily all referring to the same implementation or implementation, nor are separate or alternative implementations/implementations mutually exclusive of other implementations/implementations. Yet furthermore, the order of process flow representing one or more implementations or implementations of the fabric security bag does not inherently indicate any particular order nor imply any limitations of the fabric security bag.

Furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Introduction

The fabric security bag implementations described herein are directed to a heavy fabric closable draw string security bag. In general, implementations of the fabric security bag can be easily closed, are resistant to be cut with a knife or the like to get to the contents of the fabric security bag, and are lockable so would be an ideal storage device for the apartment dweller, home owner, business operator and the like since the fabric security bag can be removed when not needed for an expectant deliverable purchased item and can be secured to the door knob or handle of the front or main door or the delivery door. However, to prevent penetration of the fabric security bag with a knife or the like, the fabric security bag would be constructed of a cut-resistant fabric, such as Kevlar brand fabric, or a high-density polyethylene woven, or an unwoven mesh or felt-like fabric. The seams of the fabric security bag's fabric would be hidden if the seams are sewn, stapled, riveted, and/or adhesively bonded. In addition, the opening of the fabric security bag must be able to be reduced to a small size to prevent entry through the fabric security bag opening with the hand or an instrument or tool when the fabric security bag has been closed and the closure locked by the delivery person. Such a fabric security bag is particularly useful for an apartment dweller where a box may not be feasible because it could partially obstruct the apartment hallway. Thus, a bag owned by an apartment dweller can be removed from the hallway when no delivery is expected, or contemplated, or the delivery has been made. Similarly, the fabric security bag can be removed from front door of a home or the delivery door of a business and stored away until needed again for an expected delivery of a purchased item. The fabric security bag can be secured to the doorknob of the door when a delivery is expected. For homes having a pedestal mailbox, the fabric security bag can be secured to the post supporting the mailbox.

The fabric security bag implementations described herein have a security or cut-proof fabric. Such fabrics are heavy and not necessarily waterproof barriers or barriers to dust and the like. Thus, if the fabric security bag gets rained upon and the fabric security bag is not waterproof, water can seep into the fabric security bag and wet the contents of the fabric security bag. Similarly, if the fabric security bag is not a barrier to dust or the like, and the fabric security bag is exposed to dust, sand, dirt of the like, the dust, fine particles of sand or dirt may enter the fabric security bag and expose the contents of the fabric security bag to such dust, etc. To protect the contents of the fabric security bag, the security fabric (the term fabric security bag herein means both security fabric and cut-proof fabric) can be laminated or covered with a water-proof or water-resistant fabric. Water-resistant fabric will mean both water-resistant and water-proof fabric herein. The water-resistant fabric layer of the security fabric/water-resistant fabric laminate or cover would be positioned on the outside of the fabric security bag with the security fabric facing inward into the fabric security bag. The water-resistant fabric will normally not be security grade fabric and will be much lighter than the security fabric. The water-proof or water-resistant fabric can be adhered to the security fabric with a glue or binder that will bind to both the water-resistant fabric and the security fabric, or it can be sewn, stapled, and/or riveted to the security fabric with any perforations being sealed.

In one implementation, the fabric security bag includes a heavy fabric front wall and heavy fabric back wall joined at their opposing first and second side edges and at their bottom edges. The fabric security bag has a closable open top. The top is closed by drawing out the draw strings located around the periphery of the fabric security bag opening. The front and back walls of the fabric security bag are fabricated with one or more pieces of heavy fabric, such as security fabric. The seams can be sewn, riveted, stapled, adhesively bonded using an adhesive, glue or polymeric binder that will adhere to the fabric and bind fabric seam, or joined using other appropriate methods. In addition, a combination of methods can be used. It is noted that the use of staples either by themselves or in combination with another joining method adds extra security as the staples will further inhibit the seams from being cut to gain access to the interior of the bag. The seams of the fabric security bag can be external or internal. However, internal seams are advantageous because when the seams are sewn, the sewing thread is not accessible, at least not easily accessible, for cutting from the exterior of the fabric security bag. In various fabric security bag implementations described herein, the heavy fabric is a security fabric which is cut resistant to prevent the fabric security bag from being easily penetrated by cutting through the fabric with a knife or the like.

The top ends of the front and back fabric panel sides or walls of fabric security bag implementations described herein terminate at the closable open top of the fabric security bag. Thus, the opening of the fabric security bag is surrounded by the tops of the fabric security bag wall[s]. A top portion of front wall can be folded over and secured to the interior side of the front wall to form a first cable channel housing having entries about the first and second side edges of the fabric security bag. A top portion of the top of the back wall is folded over and secured to the interior side of the back wall to form a second cable channel housing having entries about the first and second side edges of the fabric security bag. The top edge or portion of the front and back wall are aligned in the same plane, in other words the front wall and the back wall of the fabric security bag have the same height and the tops of the front wall and the back wall are basically even with each other. The alignment of the top edges of the front and back walls provided for better closure of the fabric security bag. However, the top edges do not have to be aligned as long as the closure of the fabric security bag opening is not detrimentally affected by the lack of alignment. In most cases, the top opening of the fabric security bag and the bottom of the fabric security bag will reside in parallel planes, but the top opening of the fabric security bag and/or the bottom of the fabric security bag can be angled with respect to each other.

In another fabric security bag implementation, the cable channel housings can be created from a separate security fabric and the fabric wall of the cable channel housing can be secured to the front and back walls of the fabric security bag at the open end of the fabric security bag by thread stitching or staples or rivets, and/or by binding with an adhesive, glue or other binder. The adhesive, glue or binder are of any type that binds to the security fabric of the front and back walls of the fabric security bag and the fabric of the cable channel.

The fabric security bag implementations described herein are fitted with at least one cable for closure of the fabric security bag. The term cable herein includes metal cable (such as steel wire cable), cotton and fiber rope, cord and cable, and polymer cable (such as polyester fabric cords), such as nylon rope. For fabric security bags, steel wire cable is particularly advantageous because of its strength and toughness. The top of the fabric security bag around its opening has a cable channel within a cable channel housing. The fabric security bag opening is closed by drawing the cable from the cable channel housing of the fabric security bag which collapses the fabric of the cable channel housing around the fabric security bag opening to reduce the size of the opening to prevent items in the fabric security bag from escaping the fabric security bag. Each cable channel housing has at least two entries. The two entries are normally adjacent each other on the same side of the fabric security bag opening.

Figure 23:
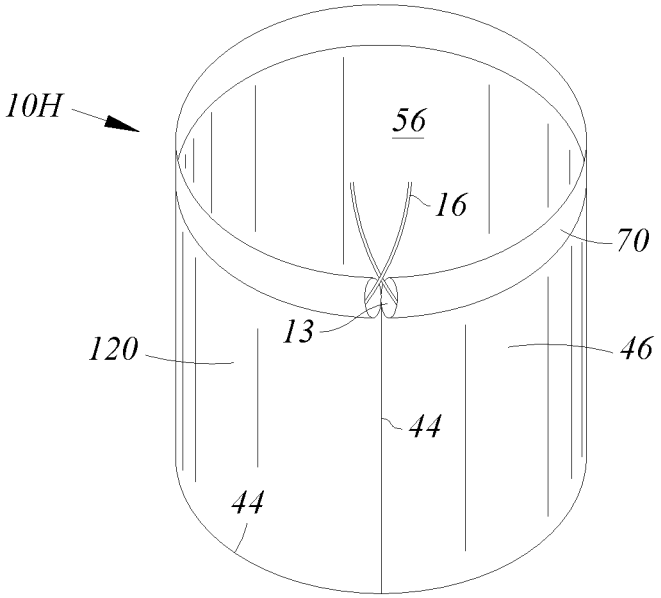
FIG. 23 is a top front perspective view of still another implementation of the fabric security bag.

Each cable channel housing is adapted is to receive a cable in a slidable relationship within the cable channel of the housing. Some fabric security bags have a single cable for drawing the opening of the fabric security bag closed. For one fabric security bag implementation with a single cable, the cable enters the first entry of the first cable channel housing at the first side or edge of the fabric security bag and runs through and out the first cable channel second entry at the second side or edge of the fabric security bag and bends around and enters the second entry of the second cable channel at said second side or edge of the fabric security bag and runs through and out the first entry of the second cable channel at said first side or edge of the fabric security bag. The channel can also be continuous, as in the a round fabric security bag there would only be two openings, both in the front as is FIG. 23. Thus both ends of the cable exit the fabric security bag adjacent each other. When the cable is drawn by pulling both ends of the cable out of the first and second cable channels, the walls of cable channel housing collapse and the opening of the fabric security bag is closed down.

In one implementation, the fabric security bag can have two or more cables running counter to each other for drawing the fabric security bag closed. For those fabric security bags with two cables, the first cable enters the first entry of the first cable channel at the first side or edge of the fabric security bag and runs through and out the first cable channel entry at the second side or edge of the fabric security bag and bends around and enters the second entry of the second cable channel at the second side or edge of the fabric security bag and runs through and out the second cable channel entry at the first edge. Thus, the two ends of the cable exit the same side of the fabric security bag adjacent each other. The second cable enters the second entry of the first cable channel at the second side or edge of the fabric security bag and runs through and out the first cable channel entry at the first side or edge of the fabric security bag and bends around and enters the first entry of the second cable channel at the first side or edge of the fabric security bag and runs through the second cable channel and out the second cable channel entry at the second side or edge. Thus, each cable enters and exits the cable channels at the same edge and each of the two cables enter and exit from opposite edges of the fabric security bag.

Each cable channel housing can be formed from a single sheet or multiple sheets of fabric. In one implementation, the housing side wall is U-Shaped in cross-section but can have another cross-sectional shape, such as a square or rectangular cross-sectional shape. The cable channel housing is conveniently fabricated from the top portion of the fabric panels surrounding the fabric security bag opening. The top portion of the fabric panel is folded over forming the cable channel. The top edge portion of fabric panel is folded over and down to the interior side of the fabric panel forming the cable channel. The top portion of the fabric panel is secured to the interior side of the fabric panel to form the cable channel housing which walls in the cable channel. An inner seam of the housing forms the bottom of the cable channel. The continuous wall of the housing enclosing the cable channel and the portions of cable[s] therein. Optionally the top edge portion of the fabric panel can be folded to the front side of the fabric panel to form the cable channel housing.

The cable channel housing of various fabric security bag implementations described herein do not have cable channels enclosed within continuous walls. The walls have cut-out sections. The cut-out sections or voids can be of various shapes and sizes. The cut-out sections of the fabric wall of each cable channel can extend to the bottom of the cable channel. In one implementation, the cut-out sections or voids of the cable channel of the fabric security bag can extend anywhere from halfway down the walls of the cable channel housing to the bottom of the cable channel or anywhere in between. The cut-out sections or voids can also extend below the bottom of the cable channel.

The fabric walls of each cable channel housing of the fabric security bag implementations described herein have cut-out sections voids along the length of each cable channel housing to reduce the amount of fabric of the housing. When the amount of fabric is reduced, this permits the length of the cable channel housing to be reduced to a great degree than a comparable housing with continuous walls, i.e., no cut-out sections or void. The greater the length of the housing can be reduced, the more the cable channel housing can be compressed to a smaller volume which in turn permits greater closure of the opening of the fabric security bag. A draw string fabric security bag can never be fully closed because the fabric in the cable channel housing occupies volume which affects the degree of closure of the fabric security bag opening. However, for a fabric security bag of the same dimensions and fabric, the fabric security bag implementations described herein can be closed to a greater degree than a conventional fabric security bag.

The cut-out portions of the cable channel housing give the cable channel housing a tooth like appearance with teeth and voids or spaces between the teeth. The cut-out portions or voids of the cable channel housing results in each housing having less fabric along its length which permits each cable channel to be compressed to a shorter linear length which results in a tighter closure of the open top of the fabric security bag when closed by drawing the cable[s] ends out of the fabric security bag's cable channel[s]. Depending upon the distance around opening of the fabric security bag, i.e., the length of the cable channel housings, and the weight and volume of the fabric of the cable channel housing and the fabric security bag walls, the degree of closure of a draw string fabric security bag can vary by a considerable degree. The longer the length of the cable channel housing, the greater the volume of compressed fabric when the cable is drawn out of the cable channel housing[s] to affect closure. Likewise, the greater the volume and/or weight of the fabric, the greater the volume of compressed fabric when the cable is drawn out of the cable channel housing[s] to effect closure.

1.1 Fabric Security Bag Implementation Details

Referring to FIG. 1, in one exemplary implementation, the opening 22 of a single cable fabric security bag 10 having a fabric security bag body 12 is shown with the two free ends of the cable 16 extending out of the entries 13 of the cable channels of the fabric security bag at the first side edge 28 of the fabric security bag. In the depicted implementation, the drawstring or cable 16 has not been drawn out of the cable channels in the cable channel housing of the fabric security bag 10 and the opening 22 is fully open.

Figure 2:
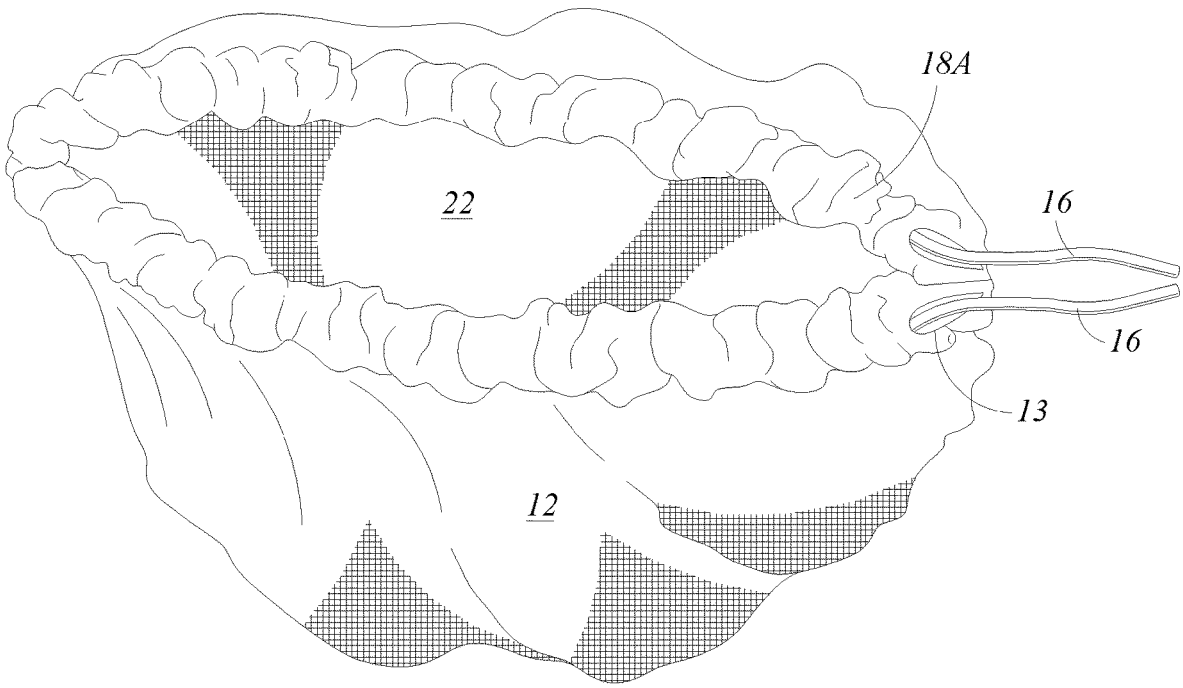
FIG. 2 is a perspective view of the top portion of a conventional draw string fabric security bag.

A draw string fabric bag made of heavy fabric is shown in FIG. 2. This fabric bag has a fully enclosed, continuous cable channel housing 18A around its opening 22 at the top of the body 12. In this drawing, the cable 16 of the fabric bag has been drawn out of the cable channel entries 13 in an attempt to close the fabric security bag opening 22. The fabric bag opening 22 has been closed to the extent possible. As is illustrated, it is not possible to compress the continuous heavy fabric walls of the cable channel housing to any great extent. This prevents full closure of the opening. Most conventional fabric bags are made of a medium or light weight fabric, not the heavy fabric of the fabric bag shown in FIG. 2, and it is possible to more fully compress the continuous fabric wall of the cable channel housing than a cable channel housing having a continuous fabric wall made of a heavy fabric.

Figure 3:
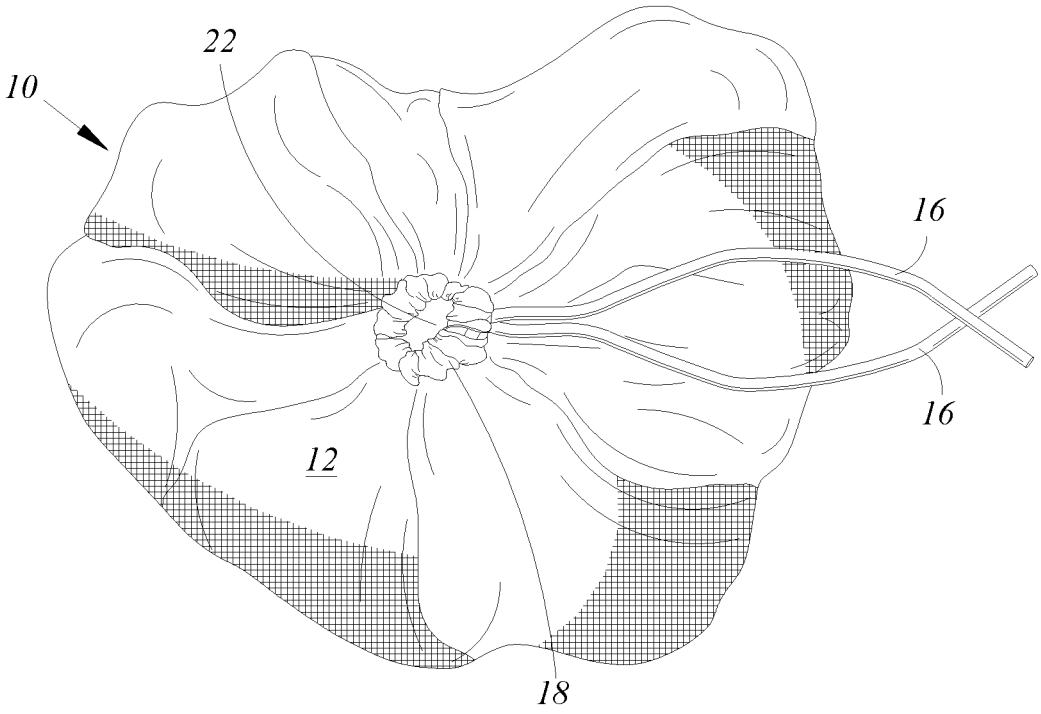
FIG. 3 is a perspective view of a top portion of an exemplary implementation of the fabric security bag.

In FIG. 3, the fabric security bag implementation of FIG. 1 is illustrated in its closed condition. The fabric security bag 10 has a body 12 like the fabric security bag of FIG. 2 but with toothed cable channels as described herein. Toothed cable channels do not have continuous fabric walls. The toothed cable channel is hidden by the collapsed fabric of the cable channel housing wherein the cable 16 of the fabric security bag has been drawn out of the cable channel of the cable channel housing 18 to close the fabric security bag opening. The fabric security bag opening 22 has been closed to a far great extent than the opening of the fabric security bag of FIG. 2. The cable channel of this fabric security bag (FIG. 3) is a toothed cable channel made of heavy fabric. It is possible to compress the continuous heavy fabric walls of the toothed cable channel because the cable channel walls are made of only about 50% of the fabric that the cable channels of the fabric bag of FIG. 2. This permits the heavy fabric cable channel to be compressed to a greater extent than the continuous heavy fabric cable channel of FIG. 2 and so permits greater closure of the fabric security bag opening than is possible with the fabric bag of FIG. 2. Closure of the opening 22 of a fabric security bag 10 is important to prevent theft of the fabric security bag contents through the fabric security bags closed off opening.

Figure 4:
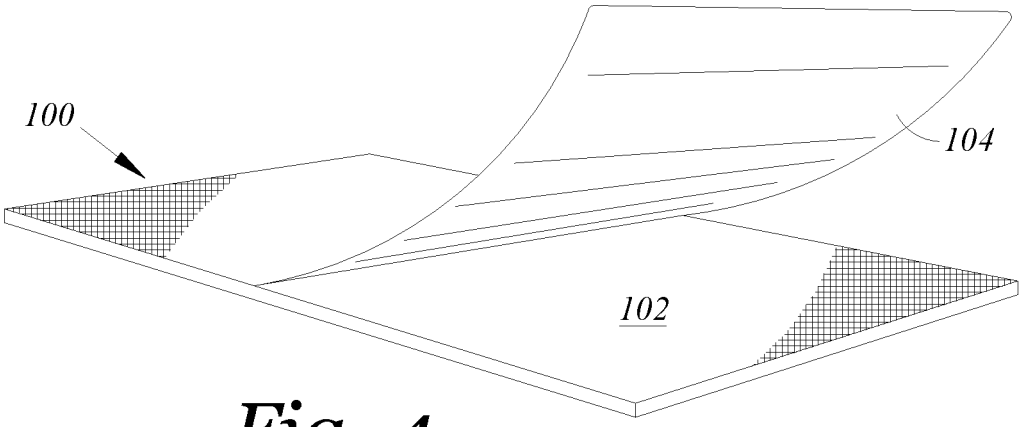
FIG. 4 is a perspective view of the laminate fabric of a fabric security bag implementation.

Referring to FIG. 4, a fabric laminate 100 of the heavy fabric 102 is shown. By heavy fabric is meant structural fabric, security fabric, heavy non-security fabric and heavy non-structural fabric. Structural fabrics and security fabrics are heavy by their very nature. The heavy fabric 102 is adhered to, or paired with without adhering, a light or medium weight fabric sheet or panel 104. It is noted that for the purposes of this description the terms "fabric laminate" or "laminated" will refer to material having two or more layers of fabric regardless of whether the layers have been adhered together or not. The fabric sheet 104 is usually the outer fabric covering of the fabric security bag implementations described herein. A second light or medium weight fabric sheet or panel (not shown) can be adhered to, or paired with without adhering, the other side of the heavy fabric 102, i.e., the side of the heavy fabric opposite to the side of the heavy fabric laminated or paired with panel 104. The light or medium weigh fabric sheet or panel 104 is normally not a structural or security fabric. The fabric sheet or panel 104 can be selected from a number of fabrics, such as, nylon, ballistic nylon, Rip-Stop Nylon, cotton, cotton-polyester, polyester, brocade, canvas, rayon, vinyl, Dyneema brand composite fiber, microfiber, Packcloth and polyurethane fiber fabrics. Still further, instead of a single sheet of heavy fabric as described above, two or more sheets can be adhered together, or layered with without adhering. When the layers are adhered together, the heavy fabric 102 and the fabric sheet 104 are adhered with a glue, adhesive or another binder (collectively "adhesive" or "binder" herein) that will bond to the surface of both the heavy fabric 102 and fabric sheet 104 and that is suitable for the end use of the fabric laminate 100. An adhesive that will not render the laminate stiff and cardboard like is advantageous. The objective is to have a fabric laminate 100 that still has the properties of a fabric and can be folded and/or rolled. Hot melt adhesive powder, such as co-polyester powder ("Co-PES"), copolyamide powder ("Co-PA"), polyurethane binder ("TPU"), polyethylene binder ("PE"), EVA or a web adhesive, such as a nylon polysmide, a polyester as Ellsworth SH4275FR-A or similar adhesive can be used. Some binders and adhesives are used as a hot melt to bind the fabrics 102 and 104 and others are used at room temperature. These binders and adhesives will provide strong durable bonds between the heavy fabric and the aforementioned light or medium weight fabrics used in the fabric laminate 100. It is further noted that when the fabric laminate has more than two layers of fabric, some of the layers can be adhered together and others may not.

The structural or security fabric 102 and the fabric sheet or panel 104 can also be laminated by means of sewing or quilting. In one implementation of the fabric security bag, the heavy fabric 102 can be cut prior to being laminated to fabric sheet 104 to form the voids of the toothed design of the cable channel housing described below (see FIGS. 8, 9 and 17-19). After the heavy fabric has been cut, the heavy fabric is laminated to the fabric sheet 104. When the fabric security bag is assembled with the cable channel housing, described below, the fabric sheet is positioned to the exterior, and it hides the toothed design of the cable channel housing.

In one implementation, the structural or security fabric 102 is a cut resistant fabric. Such fabrics are difficult to penetrate with a sharp instrument, such as a knife or pick, and are very difficult to cut with a knife or scissors. Some structural and security fabrics, such as Kevlar brand fabrics, can also offer some resistance to penetration by a bullet. In one implementation, the structural and security fabrics are ultra-high molecular weight polyethylene ("UHMWPE" herein) unwoven fabrics. It is believed that the unwoven UHMWPE fabric is a good choice because the unwoven UHMWPE fabric is stronger on a weight-by-weight basis over the other fabrics. UHMWPE unwoven fabric is available from a number of sources including Zhejiang DWD Environmental Technology Co. Ltd. At No. 1 Huaquan Industrial Zone, Tiantai, Zhejiang, China (http//www.zjdwd); Beijing Evergrow Resources Company in Beijing, China; HV Networks (Shanghai) Co. Ltd. in Shanghai, China; and Wuxi Wenqi Industry and Trade Co., Ltd in Jiangsu, China.

Figure 5:
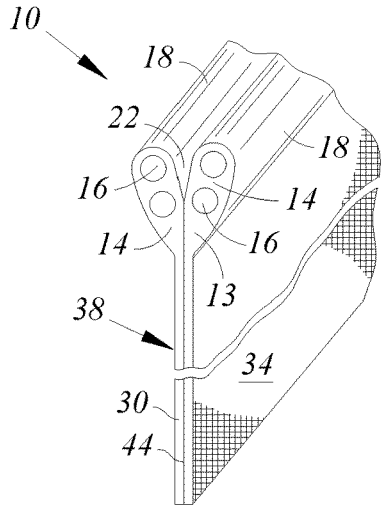
FIG. 5. is an edge on perspective view of a draw string of an exemplary implementation of the fabric security bag.

Referring to FIG. 5, an edge-on perspective view of the top portion of one fabric security bag implementation is shown with the front panel 34. The side edges of the front panel 34 and the back panel 38 (not visible) are joined at seam 44 to form the side edge 30 of the fabric security bag. The front panel 34 of fabric laminate is secured to the back panel 38 (not visible except on the edge) by edge seam 44. The fabric security bag panels can be fabricated from a single sheet of fabric laminate, or each panel can be fabricated as a separate sheet of fabric laminate. If the fabric security bag is made of a single sheet of fabric laminate, the bottom edge of the fabric security bag can be a fold of the fabric laminate and the front panel 34 and the back panel will be formed from the same sheet of laminate with the two panels joined at their side edges by seams 44. The side edges of the fabric security bag will be bound together as sewn, riveted, stapled, and/or bonded seams as described below. Alternatively, if the fabric security bag is made of a single sheet of fabric laminate, one of the side edges of the fabric security bag can be a fold of the laminate and the front panel 34 and the back panel will be formed from the same sheet of laminate. The side edge of the fabric security bag created from the free edges of the fabric laminate sheet and the bottom edge also created from the free edges of the fabric laminate sheet will be bound together as sewn seams and/or bonded seams as described herein. If the fabric security bag is made of a two separate equal sized sheet of laminate, both side edges of the fabric security bag and the bottom edge will be created from the free edges of the two fabric laminate sheets. Three of the free edges of the two laminate sheets will be bound together as sewn, riveted, stapled and/or bonded seams to form a fabric security bag implementation with closed sides and a closed bottom to form the classical fabric security bag shape having a single opening like a pillowcase or purse. Thus, the fabric security bag can be thought of as a purse-like bag with front and back panels joined at their side and bottom edges with an open top. The described fabric security bag will have what is referred to as a draw string opening which is closed by pulling the strings away from the fabric security bag. However, the fabric security bag implementations described herein are not limited to such a design and the fabric security bag can have triangular, square, rectangular, pentagonal cross sections shape, and the like.

Still referring to FIG. 5, the opening 22 at the open top of the fabric security bag is surrounded by a cable channel housing 18. The cable channel has two separate openings 13 adjacent each other and one end of the draw string 16 exits one cable channel opening and the other end of the draw string exits the other cable channel opening. Thus, the cable channel 14 with the draw string 16 encircles the fabric security bag opening 22. The ends of the cable[s] which are the draw string[s] for the fabric security bag implementations described herein are drawn or pulled out from the channel 14 compressing the fabric walls of the cable channel reducing the opening size of the fabric security bag 10 to close the bag. As mentioned above virtually all available fabric security bags are made of light or medium weight fabric and the fabric of the cable channel can normally be compressed to a small volume which results in the fabric security bag opening being reduced to a relatively small size. Most structural fabrics are heavy fabrics having a weight of at least 100 grams per square meter of fabric. In contrast virtually all light or medium weight fabrics have a weight of less than 100 grams per square meter and many are less than 50 grams per square meter. In addition to having more weight, structural fabrics have more much more bulk than light weight and medium weight fabrics. In addition, structural fabrics are also far stiffer and do not compress or fold up as easily as light and medium weight fabrics.

Still referring to FIG. 5, the cable channel housings 18 of the fabric security bag 10 are formed from the top edge of the front and back panels 34 and 38 of the fabric security bag. Each cable channel 14 has a fabric housing 18 that form the walls of the cable channel. The fabric security bag 10 of FIG. 5 has two cables 16 and both cables run through the two cable channels 14 of the fabric security bag. The first cable channel 14 runs the width of the front panel 34 and has two exits or openings 13 on each end of the cable channel at the opposing sides of the fabric security bag (only one edge and one opening is shown in FIG. 5, FIGS. 8-10, 12 and 14-15 show both sides of the fabric security bag and the cable exiting out of the opening on each side of the fabric security bag). A fabric security bag implementation with only one cable has one opposing end of the cable exiting out of opening 13 of cable channel on the front panel 34 on a first edge of the fabric security bag and it has an opposing end of the cable exiting out of opening 13 of cable channel on the back panel 38 on the first edge of the fabric security bag. Thus, both ends of the cable 16 exit the two cable channels on the same side or edge of the fabric security bag (see FIG. 13). When the fabric security bag implementation has two cables 16 running through the two cable channels 14, the two ends of the first cable exit out of the openings 13 of the two cable channels on first side or edge of the fabric security bag 10 and the two ends of the second cable exit the openings of the two cable channels on the second side of the fabric security bag. Thus, both ends of the first cable 16 exit the two cable channels 14 on the same side of the fabric security bag 10 and ends of the second cable exit the two cable channels on the opposite edges of the fabric security bag.

Figure 6:
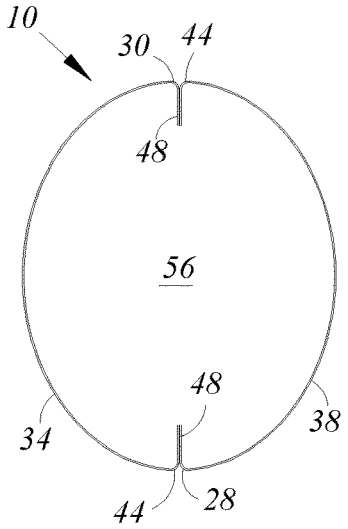
FIG. 6 is a cross-sectional view of one implementation of the fabric security bag.
Figure 7:
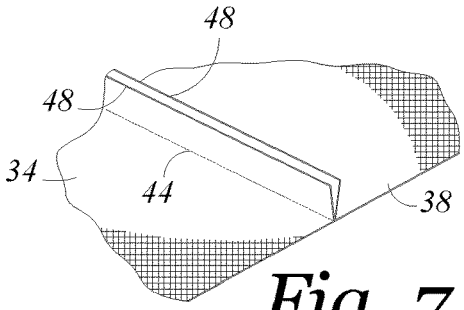
FIG. 7 is a perspective view of a sewn seam of one implementation of the fabric security bag.

Referring to FIGS. 6 and 7, the laminate fabric panels 34, 38 of one implementation of the fabric security bag 10 are bound together at the seams 44 to form the fabric security bag as shown in cross-sectional FIG. 6. FIG. 6 shows the fabric security bag interior cavity 56 which is enclosed by the fabric security bag's walls 34, 38 and open to the fabric security bag opening. The seams are internal to make it difficult to penetrate the interior of the fabric security bag by cutting through the seam from the outside of the fabric security bag. The side edges 28 and 30 and the bottom edge of the fabric security bag are formed by the seams 44 from the edge portion 48 of the front and back fabric laminate panel 34 and 38. The seam 44 can be sewn with thread as is illustrated in FIGS. 6 and 7, or the seam can be stapled, riveted, or bound with an adhesive, such as the adhesives described herein, or any combination of the above. A large variety of threads can be used to sew the seams of the fabric security bag implementations described herein, advantageously including a thread with high strength, such as a high-performance twisted multi-filament polyester thread with enhanced UV protection or resistance. UV protection is advantageous as the thread is highly resistant to UV to reduce degradation and loss of strength of the thread by exposure to the sun or other UV source. A suitable thread for sewing the seams of the fabric security bag implementations described herein includes Poly ChampFil™-Filament Polyester Thread made by Champion Thread Company, 165 Bluedevil Drive, Gastonia, N.C. 28056, Filan® Poly made by American & Efird LLC 22 American Street Mount Holly, N.C. 28120 and Bonded Polyester #001 Black made by Superior Threads 13118 NE 4th St Vancouver, Wash. 98684.

Figure 8:
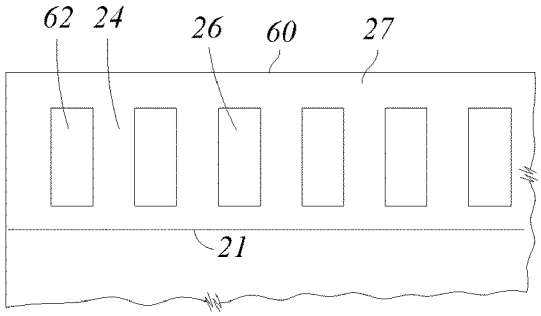
FIG. 8 is a planar view of the top part of a die cut fabric that will be made into a cable channel housing of one implementation of the fabric security bag.
Figure 9:
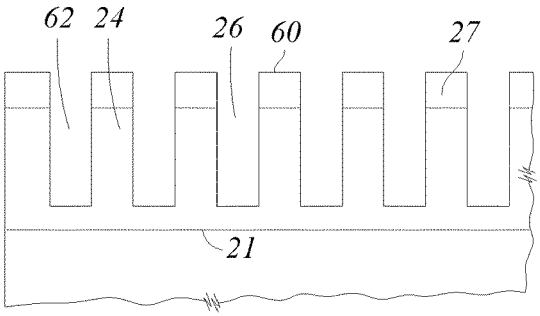
FIG. 9 is a planar view of the top part of another implementation of the die cut fabric that will be made into a cable channel housing.

As shown in FIGS. 10-16 and 19, the cable channel housing 18 of various implementations of the fabric security bag have a toothed appearance. As explained herein, reducing the amount of heavy laminate fabric from the cable channel housing 18 permits greater longitudinal compression of the housing which in turn permits greater closure of the opening 22 of the fabric security bag. This is important for a fabric security bag to prevent entry into the fabric security bag with the hand or arm when the opening has been closed off by pulling the ends of the cable[s] out of the cable channel. The cable channel housing 18 can be fabricated from the top portion of the fabric laminate sheet[s] 100 (see FIG. 4) used in the fabrication of the fabric security bag implementations described herein. Referring to FIGS. 8 and 9, the top portion 60 of the fabric laminate sheets of the fabric security bag are cut to form cut-outs 62 that will be the voids 26 of the cable channel housing. The fabric between the voids will be the teeth 24 of the cable channel housing. After the top portion of the fabric laminate sheet has been cut, the cut top portion is folded over toward the back side of the fabric laminate sheet, that is, the back side of the fabric laminate sheet is the side that will face the interior of the fabric security bag when the fabric security bag is fabricated. The end or attachment areas 27 of the top portion 60 of each sheet is secured to the back or interior side of the sheet by sewing, stapling, riveting, or adhesively bonding the end area[s] 27 to the interior side of the fabric laminate sheet, as described above for securing the seams of the fabric security bag. This is conveniently done before the fabric security bag is assembled. The end area 27 of the sheet of FIG. 8 is longitudinal strip running the width of the sheet. In contrast, the end area 27 of the sheet of FIG. 9 consists of a series of end areas 27 at the end of each finger 24. In one implementation, the end area 27 can be reinforced with a longitudinal strip (not shown) that is bonded to the outside surface of the attachment area 27 by sewing with thread, stapling, riveting or bonding with an adhesive as described herein. As will be described herein, the cut-outs 62 can be of different shapes and sizes and can extend part way down towards the bottom 21 of the cable channel or extend all the way down and even extend into the front and rear panels of the fabric security bag.

Still referring to FIGS. 8 and 9, the voids or spaces 26 between the teeth 24 extend downward toward the bottom 21 of cable channel, but not necessarily to the bottom. The voids can extend downward from about 50% to about 100% from the top of the cable channel housing toward or down to the bottom 21 of the cable channel 14 (FIGS. 5 and 18-21 which show the cable channel 14 in cross section and shows the bottom 21 of the cable chamber). The voids can also extend into the front and back fabric panels of the fabric security bag, but this is usually not necessary to remove sufficient material from the cable channel housing and the front and back panel area of the fabric security bag to obtain the desired closure of the opening of the fabric security bag as described herein.

Figure 10:
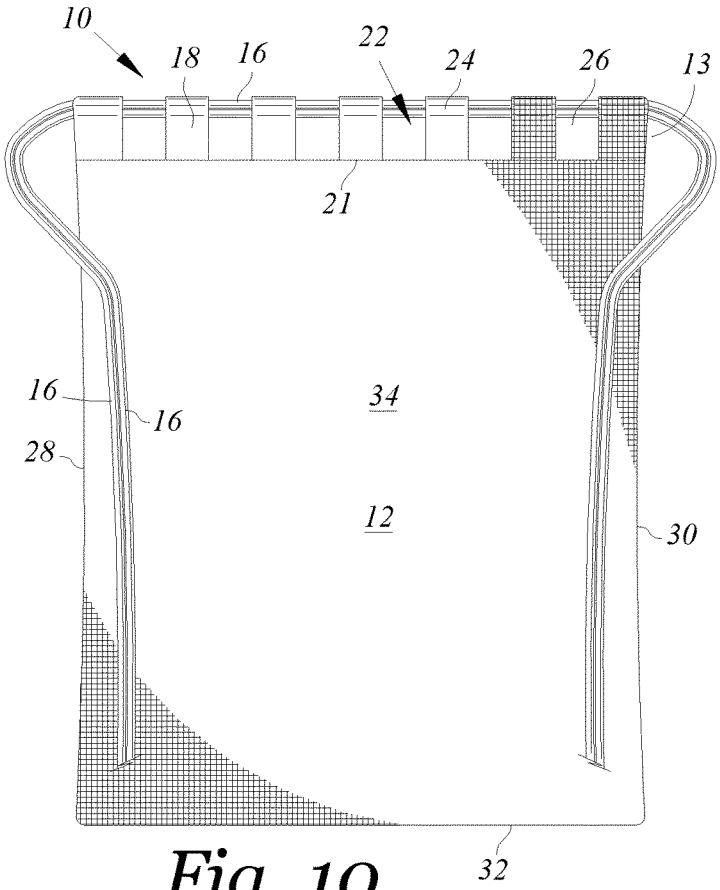
FIG. 10 is a front planar view of one implementation of the fabric security bag.

Referring to FIG. 10, the front side of one implementation of the fabric security bag 10 is shown. The body 12 of the fabric security bag has a front side comprising the front fabric laminate panel 34. The opening 22 of the fabric security bag is at the top of panel 34. The back side of the fabric security bag has a back fabric laminate panel (not shown, back sides of fabric security bags are shown in FIGS. 12-16). The front fabric panel 34 and back panel of the fabric security bag are usually identical in size and construction for a fabric security bag fabricated from two fabric panels. The front panel 34 and the back panel are bound at their first side edge 28 and their second side edge 30 and their bottom side or edge 32 with thread, staples, rivets or adhesive to create seams as described herein. The seams of the front and back fabric panels on their side edges 28 and 30 and bottom edge 32 are internal seams. The two panels when joined and bound to create a fabric security bag 10 having an internal central cavity 56 (see FIG. 6) surrounded by the front and back fabric panels and open to the outside via opening 22.

Still referring to FIG. 10, the top of the fabric security bag 10 has a cable channel within the two cable channel housings 18 to receive the two cables 16 of the fabric security bag. The cable channel housings are fabricated from the top portion of the front and back fabric panels and are an integral part of the front and back fabric panels. Alternatively, the cable channel housings can be fabricated separately and secured to the top of the fabric panels (see FIGS. 20-22). The cables are used to close the opening 22 of the fabric security bag and can be used to hold the fabric security bag, such as by holding the exposed ends of the cables or by passing the cables over a shoulder to support the fabric security bag. The cables exit the fabric security bag from the cable channel entries 13 at the ends of each cable channel housing next to the side edges 28 and 30. This fabric security bag has two separate cable channel housings 18. A cable channel housing 18 extends across the top of the front panel 34 and a second cable channel extends across the top of the back panel (not shown in FIG. 10). From the outside or exterior of the fabric security bag, the housings 18 of the two cable channels have a toothed appearance with teeth 24 and void spaces 26 separating the teeth. The voids 26 extend down to the bottom 21 of the cable channels. The purpose for this toothed configuration will be described in more detail shortly.

The first cable 16 of fabric security bag 10 of FIG. 10 enters the entry or opening 13 of the cable channel of the cable channel housing 18 of the front panel 34 on the first side edge 28. The first cable extends through this cable channel and out the cable channel opening 13 on the second side edge 30 of the fabric security bag. The cable then bends around and enters the cable channel of the cable channel housing on the back panel (not shown in FIG. 10) of the fabric security bag through the entry of that cable channel on the second side 30 of the fabric security bag (not shown in FIG. 10) and extends through that cable channel and out that cable channel via the cable channel's opening 13 on the first side edge 28 of the fabric security bag (not shown in FIG. 10). Thus, the ends of the first cable extend out the first side 28 of the fabric security bag through the openings 13 of the first and second cable channels. The second cable 16 enters the opening 13 of the cable channel of the cable channel housing 18 on the front panel 34 on the second side 30. The second cable extends through that cable channel and out the cable channel opening 13 on the first side 28 of the fabric security bag. The second cable then bends around and enters the cable channel entry of the cable channel housing on the back panel of the fabric security bag through the cable channel opening 13 on the first side 28 of the fabric security bag (not shown in FIG. 10) and extends through that cable channel and out that cable channel via the opening 13 of that cable channel on the second side 30 of the fabric security bag (not shown in FIG. 10). Thus, the two ends of the second cable extend out the second side 30 of the fabric security bag through the openings 13 of the first and second cable channels. In FIG. 10 two cable ends are shown coming out of the fabric security bag on one side edge and another two on the other side edge. One of the cables in each pair is coming out of the entries of the cable channels of the front fabric panel and the other cable in each pair is coming out of the cable channel of the back fabric panel. The ends of the first and second cables can be drawn out of the cable channels to close the fabric security bag opening 22. The ends of each cable can be joined by a conventional cable union, or they can free separate ends. If the ends of each cable are joined by a union, the union can be positioned in one of the cable channels or it can be outside a cable channel.

1.2 Cable Channel Housing

The fabric security bag implementations described herein are fabricated from heavy fabric as described above. The structural and security fabric are heavy fabrics with a weight of 100 or more grams per square meter. With the use of such a heavy fabric on a draw string type bag, it can be difficult to compress the fabric of the cable channel housing 18 of the cable channel into a small volume (see FIG. 2). Thus when one tries to close the opening of a draw string type fabric security bag fabricated from heavy fabric, such as a heavy fabric with a weight of more than 100 grams per square meter, by drawing the draw string or cable from the cable channel[s] to shorten the longitudinal length of the cable channels housing by forcing longitudinally compression of the front, top and rear walls of the cable channel housing, the volume or amount of heavy fabric in the cable channel housing resists such compression and prevents full or tight closure of the fabric security bag opening to a varying degree dependent upon the weight and/or volume of the fabric. This is shown in FIG. 2 where the heavy fabric of the walls of the cable channel housing prevented full longitudinal compression of the cable channel and prevents any appreciable closure of the fabric security bag opening 22.

As previously discussed, it has been found that by removing fabric from the front, top and rear walls of the cable channel housing 18, the cable channel housing of a fabric security bag made from heavy weight fabric can be longitudinally compressed to a far greater degree than housing of continuous whole fabric to achieve closure of the fabric security bag. The amount of fabric that is removed from the walls of the channel is dependent upon the volume and weight of the fabric and the desired degree of closure of the fabric security bag opening. For example, for the fabric security bags implementations measuring 4 feet in height and/or width, it is desirable to reduce the size of the opening to about seven square inches or less. In most instances an opening of about seven or less square inches prevents entry of a hand and arm into a closed fabric security bag. For large fabric security bags, such as fabric security bags measuring more than 4 feet in width and/or height, the closure of the opening may be larger depending upon the fabric security bags intended use. For example, if the fabric security bag is intended to hold boxes or the like having a minimum dimension of no less than ten inches, such as a box having a width and length greater than 10 inches and a height of 10 inches, the closed opening can be larger, such as 14 square inches, and still prevent easy removal of a box.

For various implementations of the fabric security bag, it has been found that for heavy fabric weighing between about 200 and about 300 grams/square meter, about 30% to 60% of the fabric of the cable channel housing should be removed to obtain the desired closure of the fabric security bag opening. Of course, if the fabric security bag is massive in size, more of the fabric might have to be removed to obtain the desired closure. For heavy fabric and fabric laminate with a weight of between about 300 and about 500 grams/square meter, about 40% to 70% of the fabric of the cable channel housing should be removed to obtain the desired closure of the fabric security bag opening. For fabric laminates with a weight of between about 500 and about 1000 grams per square meter, about ½ to about ⅔ of the fabric of the housing should be removed to obtain the desired closure of the fabric security bag opening. For a set closure of an opening, the amount of the fabric to be removed from the cable channel housing can be easily determined empirically during the fabric security bag design stage by constructing the fabric security bag of the desired heavy fabric or fabric laminate and then step wise gradually removing fabric from the walls of the cable channel housing. At each step of fabric removal, a cable is drawn through the cable channels of the fabric security bag and drawn to close the fabric security bag. When the desired degree of closure of the opening is obtained, the amount of fabric needed to be removed from the walls of the cable channel housing is known.

Figure 11:
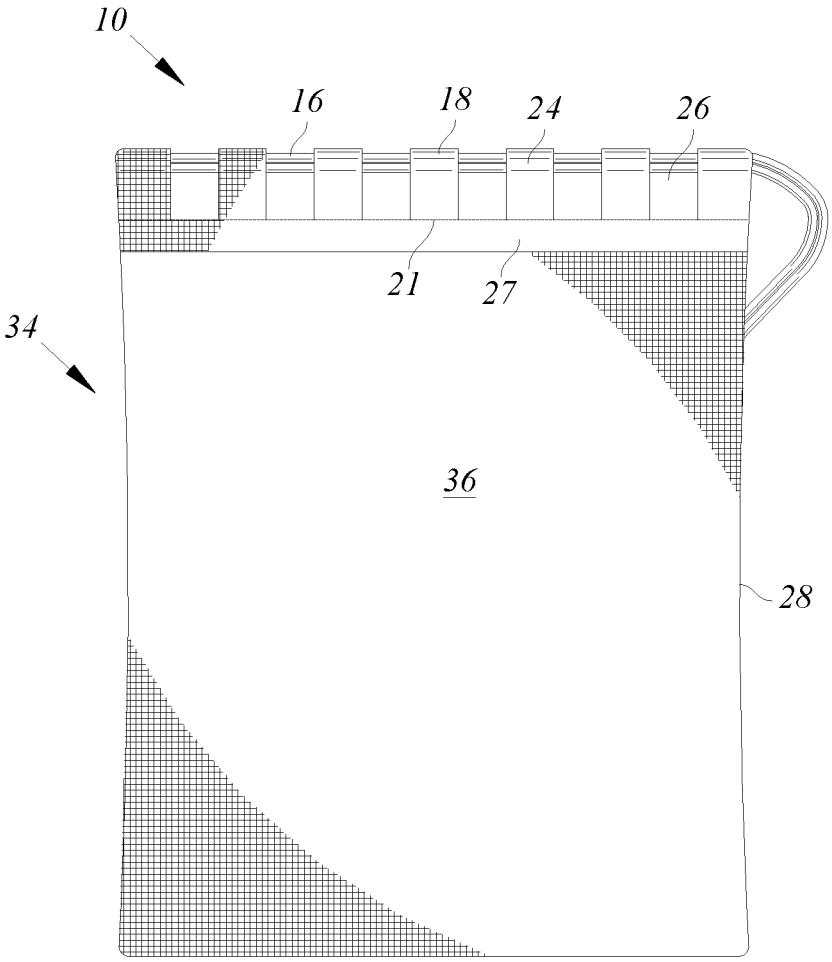
FIG. 11 is a back planar view of another implementation of the fabric security bag.

FIG. 11 shows the back side 36 of the front fabric panel 34 of fabric security bag 10 of FIG. 10. The top part of the fabric panel has been cut to form the teeth 24 and voids 26 of the cable channel housing 18. The cut top part of the fabric panel has been folded over to the back side 36 of the fabric panel and the attachment portion 27 of the cable channel housing has been secured to the back side 36 by a sewn, stapled, riveted or adhesively bonding seam as described above. The dotted line 21 identifies the position of the bottom of the cable channel. As described above with respect to FIG. 10, which illustrates the front side of this fabric panel, the fabric security bag has two cables with one end of the first cable exiting the cable channel of the cable channel housing on the first side edge of the front fabric panel and second end of the first cable exiting also on the first side edge from the entry of the cable channel of the cable channel housing of the back fabric panel (the back fabric panel is not shown in FIGS. 10-11). Similarly, one end of the second cable exits the cable channel of the cable channel housing on the second side edge of the front fabric panel and the second end of the second cable exits the cable channel of the cable channel housing of the back fabric panel on the second side edge. The two ends of both the first and second cables are visible in FIG. 10 because the back fabric panel is behind the front fabric panel. However, in FIG. 11 only a single end of the first cable and a single end of the second cable are visible because FIG. 11 only shows back side 36 of the front fabric panel 34. One end of each of the two cables exits the entry of the cable channel of the front fabric panel on the first side edge 28.

Figure 12:
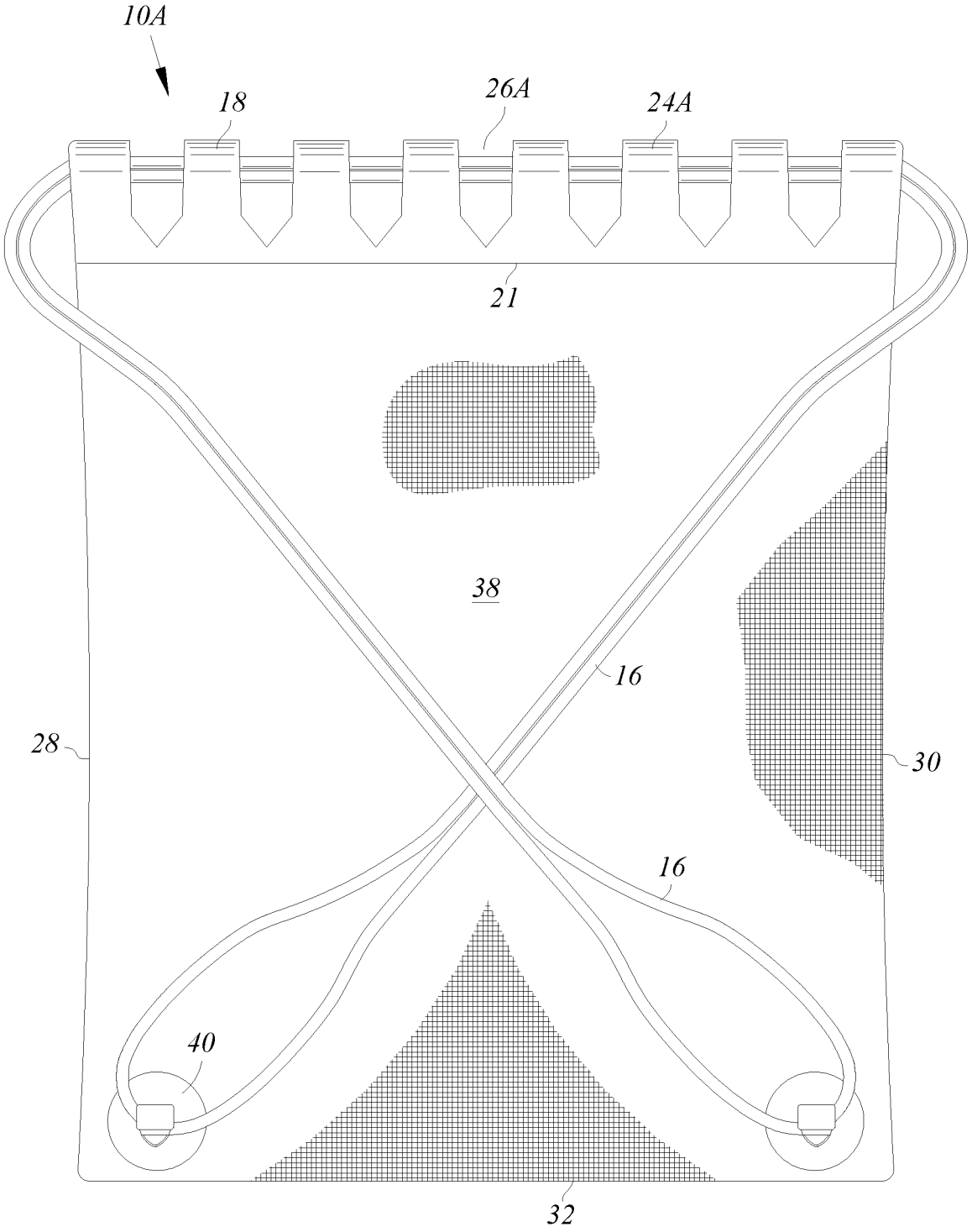
FIG. 12 is a back planar view of yet another implementation of the fabric security bag.

FIG. 12 shows another implementation of the fabric security bag. The fabric security bag 10A has basically same construction as the fabric security bag of FIGS. 10 and 11. By same construction it is meant that it is fabricated from heavy fabric laminate sheets. The security fabric of the laminate faces the interior chamber of the fabric security bag and the seams of the side edges, bottom side and cable channel housing are sewed, stapled, riveted and/or adhesively bonded. The cable channel housing 18 runs across the width of the fabric security bag from the first side edge 28 to the second side edge 30. There are differences, however. The toothed cable housing 18 has tapered voids 26A between the teeth 24A and the bottom 21 of the cable channel is below the bottom of the voids 26A. The back fabric panel 38 of the fabric security bag has cable hooks 40 secured to the bottom corners of the back fabric panel 38. Each cable hook is adapted to receive the looped end of one of the two cables 16 of the fabric security bag. The fabric security bag 10A can be carried by a person as a backpack with the cables running over the shoulders of the carrier and then diagonally across the carrier's chest and running around the carrier's upper waist with the looped end of each cable secured to separate cable hooks as shown in FIG. 12. The ends of each cable are secured together with a cable union (not shown) to form a continuous loop.

Figure 13:
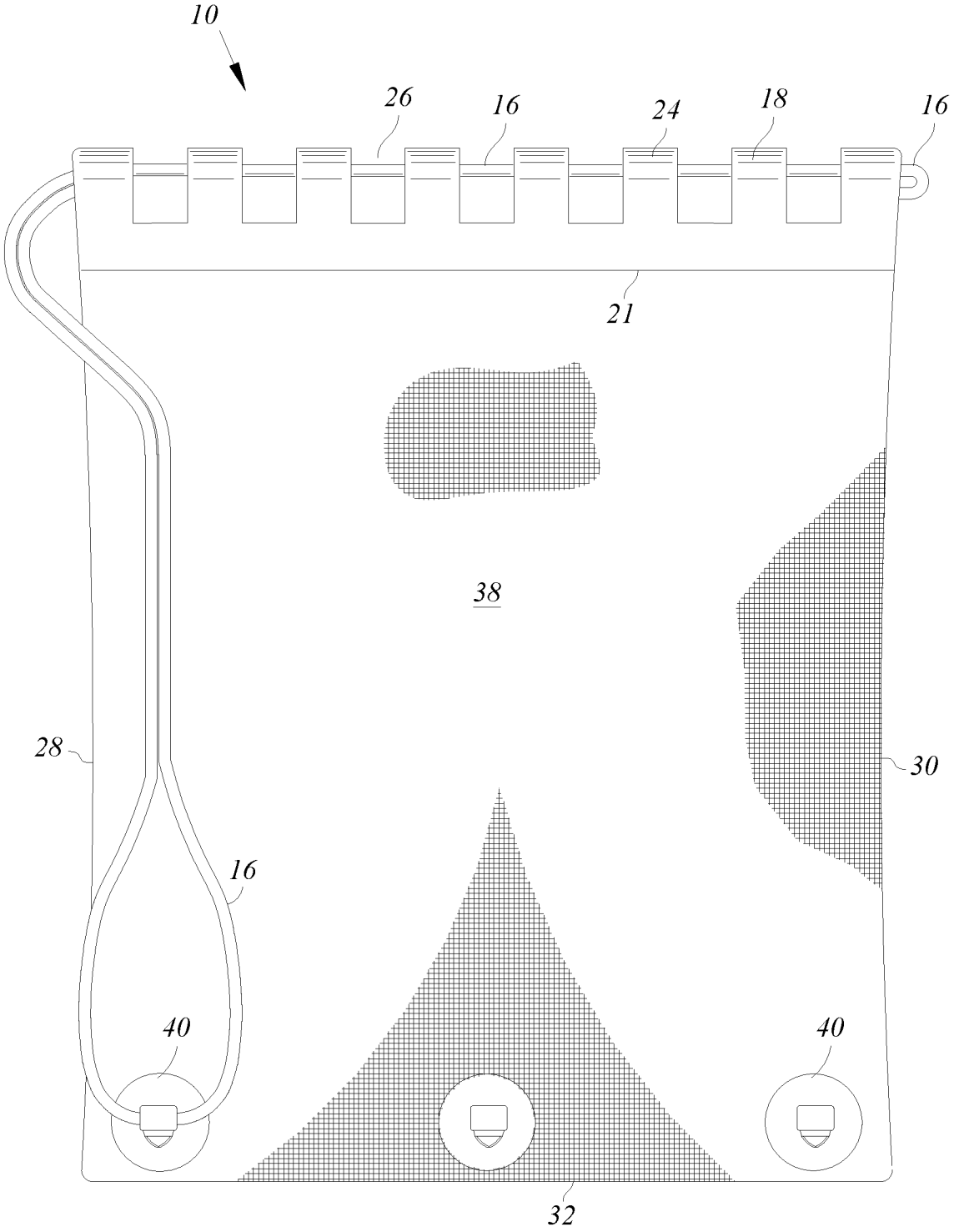
FIG. 13 is a back planar view of a further implementation of the fabric security bag.

FIG. 13 shows another implementation of the fabric security bag. The fabric security bag 10 has the basically same construction as the fabric security bags of FIGS. 10, 11 and 12. By same construction it is meant that it is fabricated from heavy fabric laminate sheet[s] with the seams of the sides, bottom side and cable channel housing are sewn, stapled, riveted and/or adhesively bonded. The security fabric layer of the laminate faces the interior of the fabric security bag. There are differences, however. The toothed cable housing 18 has rectangular voids 26 in contrast to the tapered voids 26A of the fabric security bag of FIG. 12 and the bottom 21 of the cable channel is below the voids 26 in contrast to the voids 26 of the fabric security bag 10 of FIGS. 10 and 11 where the voids extend down to the bottom 21 of the cable channel. The teeth 24 are between the voids 26. The cable housing 18 of each fabric panel runs the width of the panel from the first side edge 28 to the second side edge 30. The fabric security bag 10 of FIG. 13 has a single cable 16 which runs through the cable channels of the front and back fabric panels as described above. Since there is only one cable, only a single cable strand runs through each cable channel. The back fabric panel 38 of the fabric security bag has three cable hooks 40 secured near the bottom edge 32 at the corners and midway in between the corners of the back fabric panel 38. Each cable hook 40 is adapted to receive the looped end of the cable of the fabric security bag. The fabric security bag 10 can be carried by a person by hand or over one of the carrier's shoulders. The ends of the cable are secured together with a cable union (not shown) to form a continuous loop.

Figure 14:
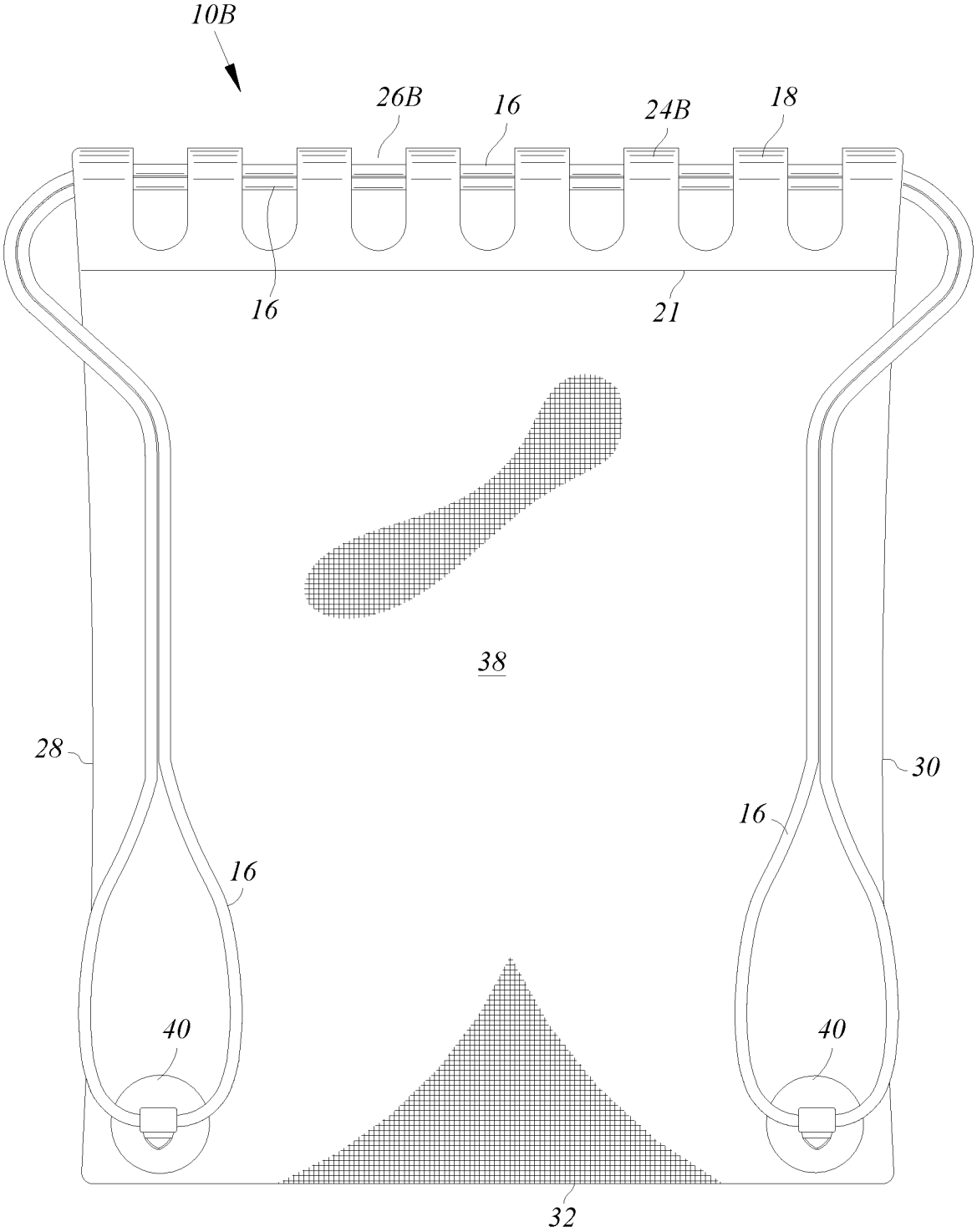
FIG. 14 is a back planar view of still another implementation of the fabric security bag.

FIG. 14 shows another implementation of the fabric security bag. The fabric security bag 10B has the basically same construction as the fabric security bags of FIGS. 10, 11, 12 and 13. By same construction it is meant that it is fabricated from heavy fabric laminate. The heavy fabric or the security fabric, as the case may be, faces the interior chamber of the fabric security bag. The seams of the side's edges 28, 30, bottom side 32 and cable channel housing 18 of the fabric security bag are sewn, stapled, riveted, and/or adhesively bonded. There are differences between this fabric security bag implementation and the previously described fabric security bag implementations. The toothed cable housing 18 of the fabric security bag 10B of FIG. 14 has voids 26B with rounded ends in contrast to the tapered voids and rectangular voids of the fabric security bags of FIGS. 10-13. The voids are separated by teeth 24B. The bottom 21 of the cable channel is below the voids 26B in contrast to the position of the bottom of cable channels and the bottom of the voids of the fabric security bag of FIGS. 10 and 11. The fabric security bag 10B of FIG. 14 has two cables 16 which run through the cable channels of the front and back fabric panels in counter directions as described above. The back fabric panel 38 of the cable housing 18 of each fabric panel runs the width of the panel from the first side edge 28 to the second side edge 30. The fabric security bag 10B has two cable hooks 40 secured near the bottom edge 32 at the corners of the back fabric panel 38. Each cable hook is adapted to receive a looped end of one of the cables of the fabric security bag. The fabric security bag 10B can be carried by a person as a backpack, similar to the fabric security bag of FIG. 12. The cables can be passed over the carrier's shoulders and diagonally across the carrier's chest as described with respect to the fabric security bag of FIG. 12, or cables can be allowed to run over the shoulders and then down and under the carrier's arms to the hooks 40 at the bottom corners of the fabric security bag as shown in FIG. 14. The ends of the cable are secured together with a cable union (not shown) to form a continuous loop.

Figure 15:
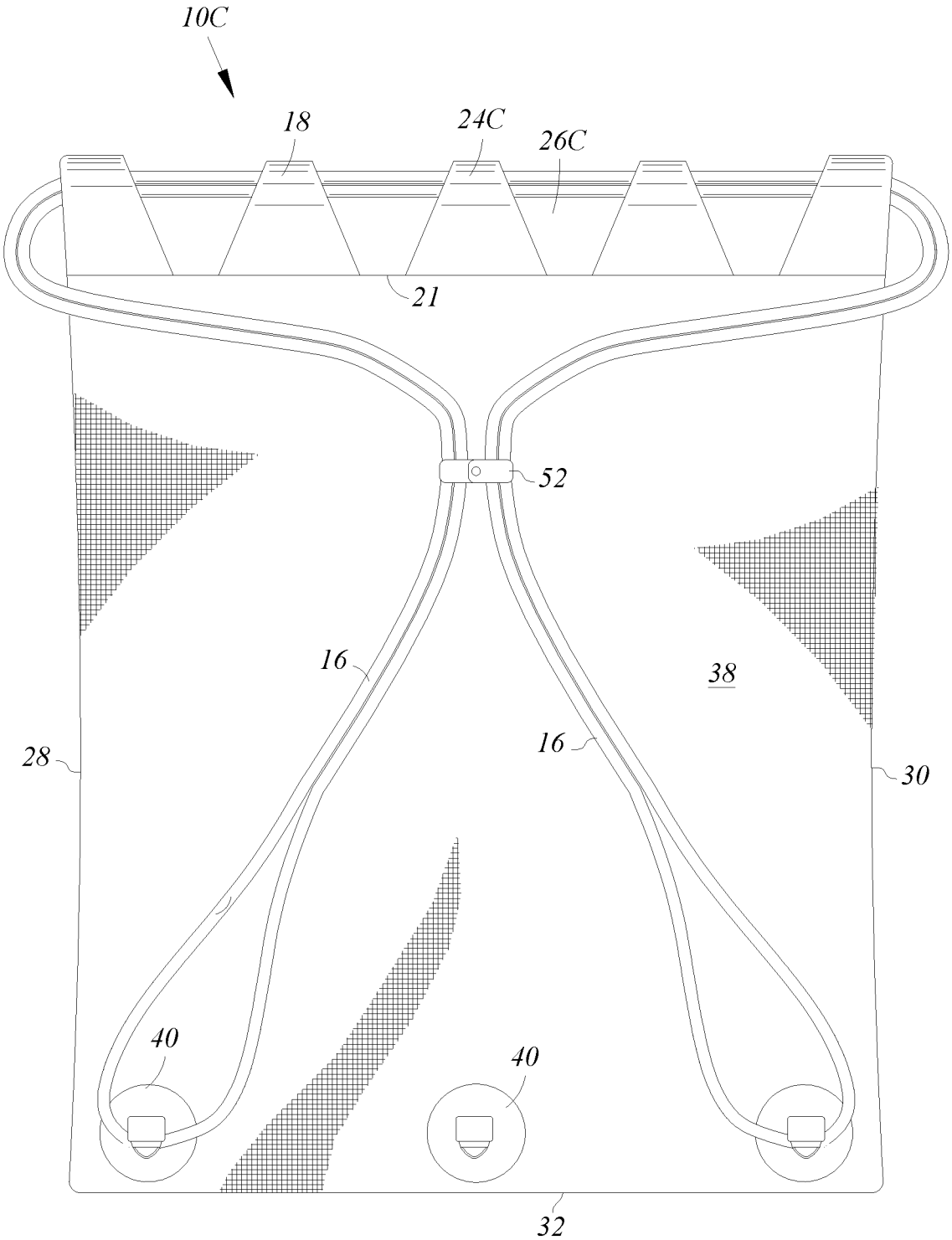
FIG. 15 is a back planar view of another implementation of the fabric security bag.

FIG. 15 shows yet another implementation of the fabric security bag. The fabric security bag 10C has basically same construction as the fabric security bags of FIGS. 10, 11, 12, 13 and 14. By same construction it is meant that it is fabricated from heavy fabric laminate. The fabric security bag is constructed so that the security fabric of the laminate faces the interior chamber of the fabric security bag. The seams of the side edges, bottom side and cable channel housing of the fabric security bag are sewn, stapled, riveted, and/or adhesively bonded. Just as there were differences in the previously described fabric security bags, there are differences between the fabric security bag 10C of FIG. 15 and the other fabric security bags described herein. The toothed cable housing 18 of the fabric security bag of FIG. 15 has tapered teeth 24C and matching, in reverse, tapered voids 26C. The voids are separated by teeth 24C. The bottom of the voids is in line with the bottom 21 of the cable channel in contrast to the position of the cable channel bottom and the bottom of the voids of the fabric security bag of FIGS. 12-14. The cable housing 18 of each fabric panel runs the width of the panel from the first side edge 28 to the second side edge 30 of the fabric security bag 10C of FIG. 15 and has two cables 16 which run through the cable channels of the cable channel housings 18 of the front and back fabric panels as described above. The cables are looped by joining their ends with cable unions (not shown). The back fabric panel 38 of the fabric security bag has three cable hooks 40 secured to the bottom corners of the back fabric panel 38 and a middle one in between the corner ones and next to the bottom edge 32 of the fabric security bag. Each cable hook is adapted to receive one of the cables of the fabric security bag. The fabric security bag can be carried by a person as a backpack. The cables can be passed over the carrier's shoulders and downward toward the carrier's waist as shown in FIG. 15. The two cables are secured together with a cable tie or clasp 52 around the chest area to help secure the fabric security bag when hiking or the like. The cables can also be crossed diagonally as shown in FIG. 12 or dropped downward towards the sides of the waist as shown in FIG. 14.

Figure 16:
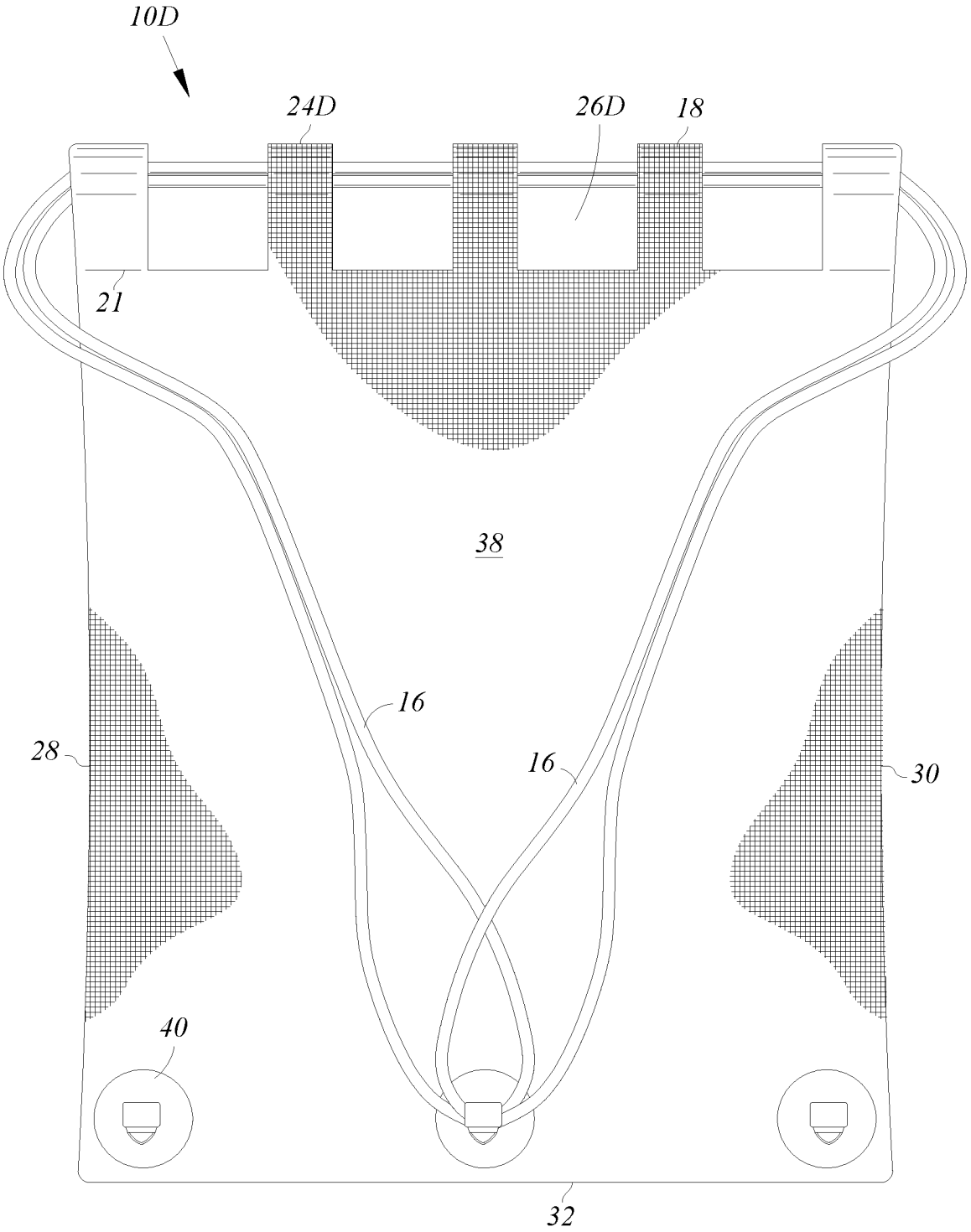
FIG. 16 is a back planar view of yet another implementation of the fabric security bag.

FIG. 16 shows still another implementation of the fabric security bag. The fabric security bag 10D has the basically same construction as the fabric security bags of FIGS. 10, 11, 12, 13, 14 and 15. By same construction it is meant that the fabric security bag is fabricated from heavy fabric laminate. The fabric security bag is constructed so that the security fabric of the laminate faces the interior chamber of the fabric security bag. The seams of the side edges 28 and 30, bottom side 32 and cable channel housing 18 are sewn, stapled, riveted, and/or adhesively bonded. Just as there were differences in the previously described fabric security bags, there are differences between the fabric security bag of FIG. 16 and the other fabric security bags described herein. The toothed cable housing of the fabric security bag of FIG. 16 has large square voids 26D which are twice as big as the area of the teeth 24D. The toothed cable channel housing design of fabric security bag 10D is designed for a fabric security bag fabricated from very heavy fabric laminate. The amount of fabric in the cable channel housing 18 has to be greatly reduced in order to obtain the desire closure of the fabric security bag opening. The bottom of the voids is in line with the bottom 21 of the cable channel in contrast to the position of the cable channel bottom and the bottom of the voids of the fabric security bag of FIGS. 12-14. The fabric security bag of FIG. 16 has two cables 16 which run through the cable channels of the front and back fabric panels as described above. The cables are looped by joining their ends with cable unions (not shown). The back fabric panel 38 of the fabric security bag has three cable hooks 40 secured to the bottom corners of the back fabric panel 38 and a middle one in between the corner ones and next to the bottom edge 32 of the fabric security bag. Each cable hook 40 is adapted to receive a looped end of the cable of the fabric security bag. The fabric security bag 10D can be carried by a person as a backpack as the fabric security bag of FIGS. 12 and 14-15. The cables 16 of this fabric security bag 10D can be passed over the carrier's shoulders. The cables are looped over the center hook 40. The cables will extend from the top of the fabric security bag, pass over the carrier's shoulders, then under the carrier's arms and then turn inward behind the carrier's back to the center cable hook. The two cables can also be secured to the cable hooks 40 like the fabric security bags of FIGS. 12 and 14-15.

Figure 29:
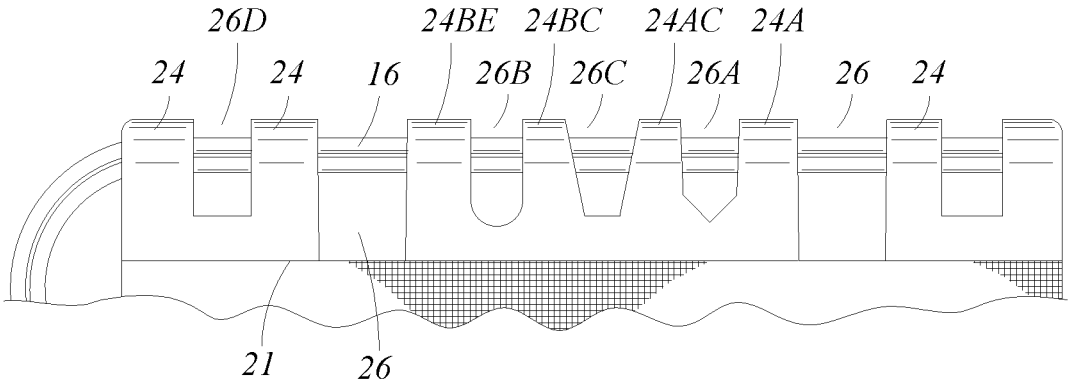
FIG. 29 is a front planar view of the top portion of the front side of yet another one implementation of the fabric security bag.

Referring to FIG. 29, the individual voids and teeth of the cable channel housing of a fabric security bag can be of different shapes, sizes and dimensions. The voids 26 are deeper than the other voids 26A, 26B, 26C and 26D and extend down to the bottom 21 of the cable channel. Tooth 24 is separated from tooth 24BE by void 26. Tooth 24BE is separated from tooth 24BC by void 26B. Tooth 24BC is separated from tooth 24AC by void 26C. Tooth 24AC is separated from tooth 24A by void 26A. Tooth 24A is separated from tooth 24 by void 26. FIG. 29 is for illustrations purposes primarily and it is believed that in most implementations, the voids and teeth of the cable channel housing of the fabric security bags will be of the same shape, size and dimensions. But there may be occasions where it is advantageous to have cable channel housing with teeth and voids of different shapes, sizes, and dimensions. When the voids between teeth are of different size and/or shape, the tooth between the voids will have unsymmetrical shapes (see teeth 24A, 24BE, 24BC and 24AC).

Figure 17:
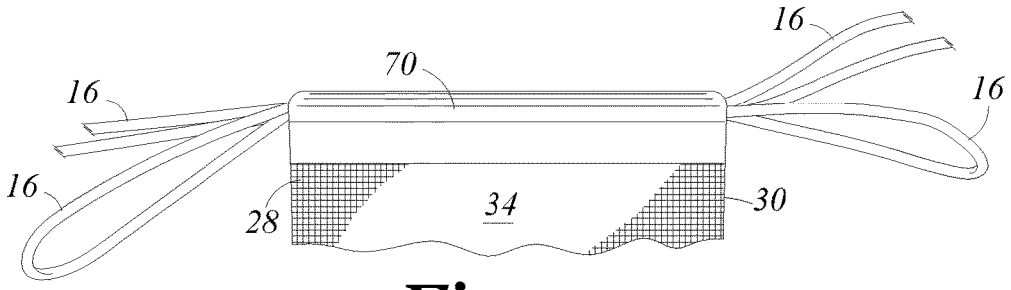
FIG. 17 is a front planar view of the top portion of the front side of one implementation of the fabric security bag.
Figure 18:
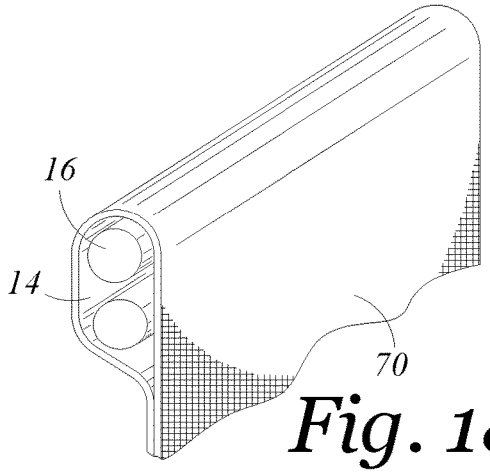
FIG. 18 is a cross-sectional perspective view of the cable channel housing of one implementation of the fabric security bag with a fabric cover.
Figure 19:
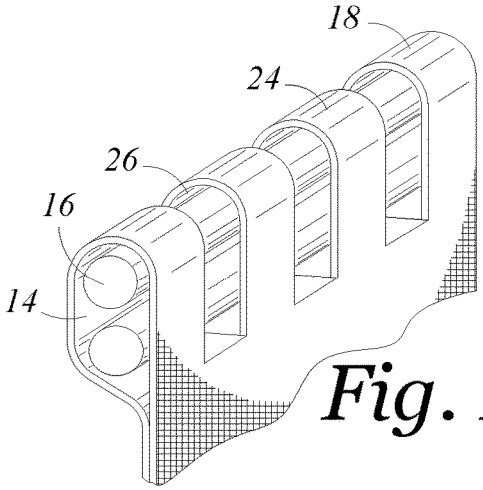
FIG. 19 is a cross-sectional perspective view of the cable channel housing of the one implementation of the fabric security bag without a fabric cover.

Referring to FIGS. 17-19, the cable channel housing 18 (FIG. 19) of a fabric security bag with teeth 24 and voids 26 can be covered with a light weight or medium weight fabric covering 70 which hides the toothed cable channel housing 18 and the portions of the cable[s] 16 running in the cable channel 14 (FIGS. 17 and 18). The use of the cover 70 can be done for ornamental purposes, and the like. FIG. 17 shows the front fabric panel 34 of a fabric security bag. One longitudinal side of the fabric cover 70 is secured to the top exterior portion of a fabric panel of the fabric security bag below the bottom of the cable channel housing (FIG. 18) by sewing, stapling, riveting or adhesively bonding, as described above. The fabric covers runs from the first side edge 28 to the second side edge 30 of the fabric security bag. The fabric panel 70 is folded over the top of the cable channel housing and the other longitudinal side of the fabric cover is secured by sewing, stapling, riveting and/or bonding to the back side of the fabric panel enclosing the cable channel housing (FIGS. 17 and 18). A medium or light weight fabric is used for the fabric covering so that the fabric covering will not unduly interfere with the closure of the fabric security bag opening by increasing the amount of fabric that must be compressed to close the fabric security bag opening. The same operation is repeated on the other fabric panel of the fabric security bag for a fabric security bag with a front and back fabric panel such as the fabric security bags of FIGS. 10-16. FIG. 17 shows the looped portions of the cables 16 that are normally positioned right next to the openings of the cable channel adjacent the first and second edge sides 28 and 30 of the fabric security bag. In FIG. 17 the looped portions have been pulled away from the sides of the fabric security bag for illustrative purposes.

Figure 20:
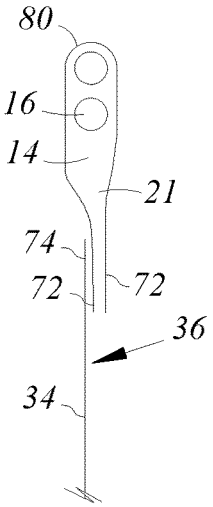
FIG. 20 is a partial cross-sectional view of the upper portion of one side of the one implementation of the fabric security bag.
Figure 21:
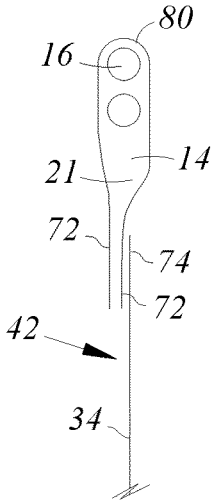
FIG. 21 is a partial cross-sectional view of the upper portion of one side of another implementation of the fabric security bag.
Figure 22:
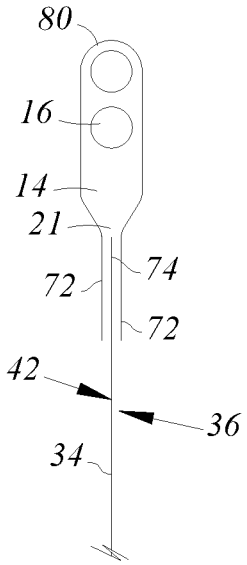
FIG. 22 is a partial cross-sectional view of the upper portion of one side of yet another implementation of the fabric security bag.

Referring to FIGS. 20, 21 and 22, three more implementations of the fabric security bag are shown. In these implementations, the cable channel housing 80 is fabricated from separate longitudinal strips of laminated fabric and is not an integral part of the fabric laminate sheet used to fabricate the fabric panels of the fabric security bag. For a fabric security bag with front and back fabric panels, there is a separate cable channel housing 80 for the front fabric panel 34 and a separate cable channel housing 80 for the back fabric panel. In one implementation, the longitudinal strips used to fabricate the separate cable channel housings 80 are pre-cut in a manner describe above (FIGS. 8 and 9) to form the toothed cable channel housing. The cut longitudinal strips are folded over lengthwise to create the cable channel housing 80. The two longitudinal edge portions 72 of the longitudinal strips are aligned and can be (1) secured to the top edge portion 74 of the exterior side 42 of the fabric security bag fabric panel (see FIG. 21) or (2) the top edge portion 74 of the inner side 36 of the fabric security bag fabric panel (see FIG. 20). In an alternative implementation, one of the longitudinal edge portions 72 of the longitudinal strip is placed on the exterior side 42 of the fabric panel 34 and the other longitudinal edge portion of the longitudinal strip is placed on the inner side 36 of the fabric panel so that the longitudinal edge portions of the longitudinal strip sandwiched the top edge portion 74 of the fabric panel of the fabric security bag (see FIG. 22). The bottom 21 of cable channel is located where the two longitudinal portions 72 join together or sandwich the top edge portion 74. The longitudinal edge portion of the longitudinal strip in the implementations of FIGS. 20-22 are secured to the top edge portion of the fabric panel of the fabric security bag by sewing, stapling, riveting, and/or bonding with an adhesive binder. The cable channel housing 80 has the cable channel 14 which is adapted to receive cables 16.

1.3 Alternate Single and Multiple Panel Fabric Security Bag Configurations

Figure 24:
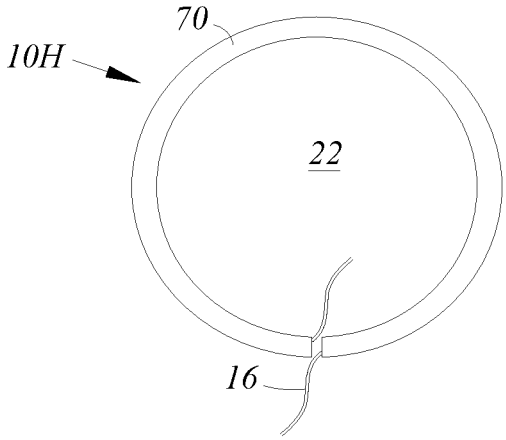
FIG. 24 is a top planar view of the implementation of the fabric security bag of FIG. 23.

Although the fabric security bag implementations described so far have been fabricated with front and back fabric panels, the fabric security bag can be made of one or more fabric panels to yield fabric security bags of different shapes having different horizontal and/or vertical cross-sections. One implementation of the fabric security bag is constructed like a military style duffel bag with a single large fabric sheet forming the side of the fabric security bag and the bottom of the fabric security bag formed from a separate sheet usually circular in shape, that has its free outer circular edge bound to the bottom edge of the sides of fabric security bag by seams. For example, referring to FIGS. 23-24, a fabric security bag 10H is illustrated having a circular horizontal cross-section. The opening 22 of the fabric security bag is basically the same size as the center cavity 56 of the fabric security bag 10H. The circular side wall fabric panel 120 is made from a continuous sheet of heavy fabric laminate 46 and opposing ends of the panel are joined at seam 44. The fabric panel can be fabricated from two or more heavy fabric laminate sheets. In the fabric security bag of FIGS. 23-24, the fabric security bag has a single toothed cable channel housing. The toothed design of the cable channel housing is hidden. The toothed design can be hidden by the fabric layer 104 as described above (FIG. 4 and FIGS. 8-9). Alternatively, the toothed design of the cable channel housing can be hidden by the exterior fabric cover 70 as discussed above. The cable channel housing has two closely positioned entries 13 for the cable 16. The fabric security bag can have more than one cable and the fabric security bag can be fabricated without the exterior fabric cover 70 in which case the toothed cable channel housing would be exposed like the cable channel housings of the fabric security bags of FIGS. 10-16. The bottom of the fabric security bag is closed off with a circular shaped sheet[s] of heavy fabric or fabric laminate (not shown). The outer edge of the circular shaped sheet[s] is secured to the bottom edge of side wall panel 120 by sewing, stapling, riveting, and/or adhesively bonding (not shown).

Figure 25:
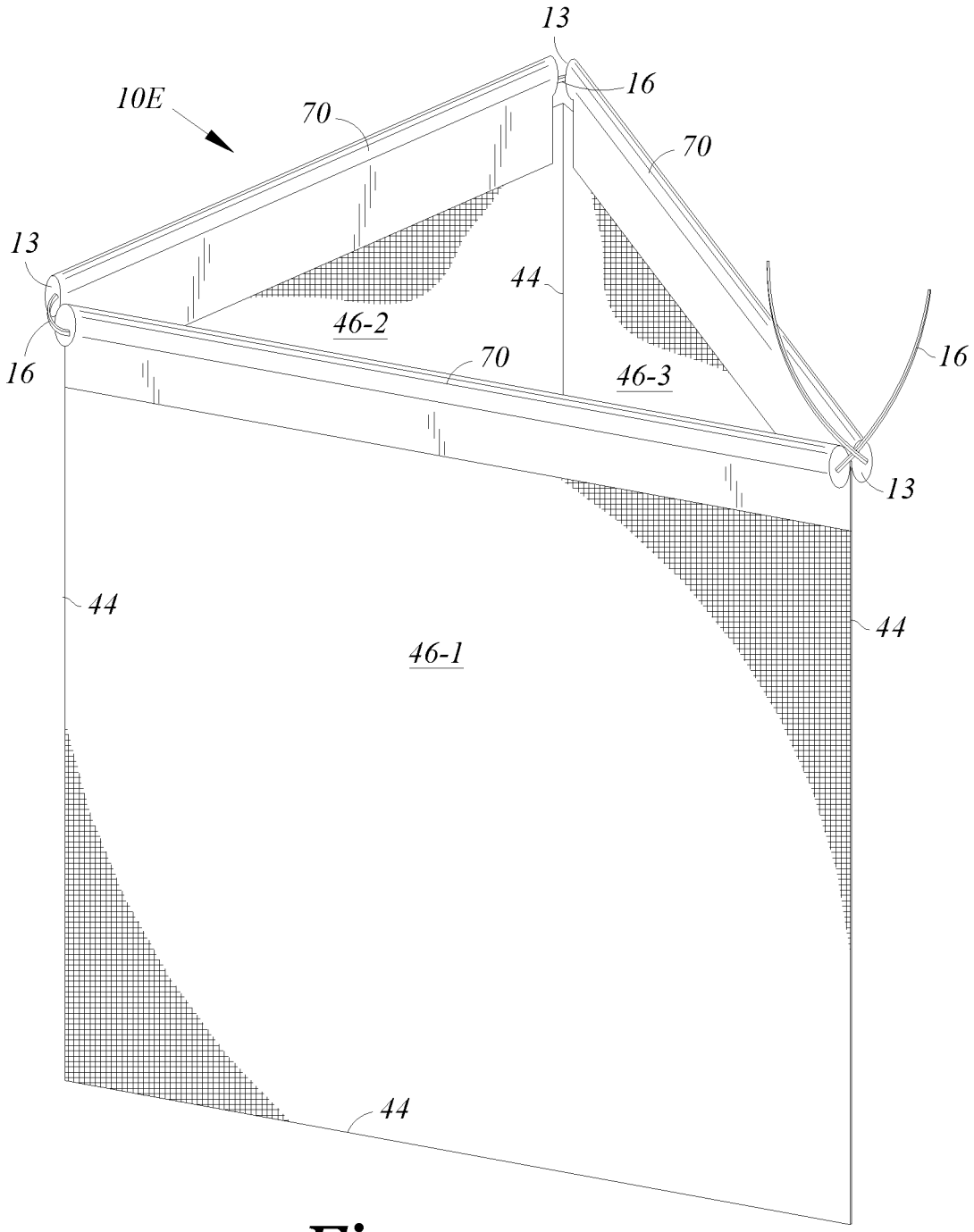
FIG. 25 is a top front perspective view of a further implementation of the fabric security bag.

Referring to FIG. 25, a fabric security bag 10E with a triangular horizontal cross-section is shown. The fabric security bag 10E has three fabric panel sides 46-1 through 46-3 with the adjacent panel sides secured to each other by seams 44, such as the left vertical edge of first fabric panel side 46-1 is joined to the right vertical edge of the second fabric panel side 46-2 along seam 44, and the left vertical edge of the second fabric panel side 46-2 is joined to right vertical edge of the third fabric panel side 46-3 along seam 44, and so on. The seams 44 are sewn, stapled, riveted and/or adhesively bonded. Each of the fabric panels 46-1, 46-2, 46-3 of the three sides has a toothed cable channel housing at the top of the fabric security bag 10E and each housing of each panel runs the width of the panel. An entry 13 into the cable channel of each housing is located at each end of each housing so that each cable channel has two entries, an entry at each end of each housing. The toothed design of the cable channel housing is hidden. The toothed design can be hidden by the fabric layer 104 (see FIG. 4) as described above. Alternatively, the toothed design of the cable channel housing can be hidden by the exterior fabric cover 70 as discussed above. The fabric security bag 10E can be fabricated without the exterior fabric covers 70 in which case the toothed cable channel housings would be exposed like the cable channel housings of the fabric security bags of FIGS. 10-16. The fabric security bag 10E has three cable channels 16. A cable runs through the cable channel housing of each fabric panel side. The cable enters one entry of a cable channel of a fabric panel side, runs the length of the channel and exits out the second entry of the channel at the other end of the housing. More than one cable can also be employed in each channel. The bottom of the fabric security bag is fabricated from one or more fabric panels (not shown). The bottom edge of each fabric panel side is joined to the corresponding edge of the bottom side edge of the fabric security bag by a sewn, stapled, riveted, and/or adhesively bonded seam 44. The fabric security bag 10E could be fabricated with one or more fabric panels depending upon the size of the fabric security bag.

Figure 26:
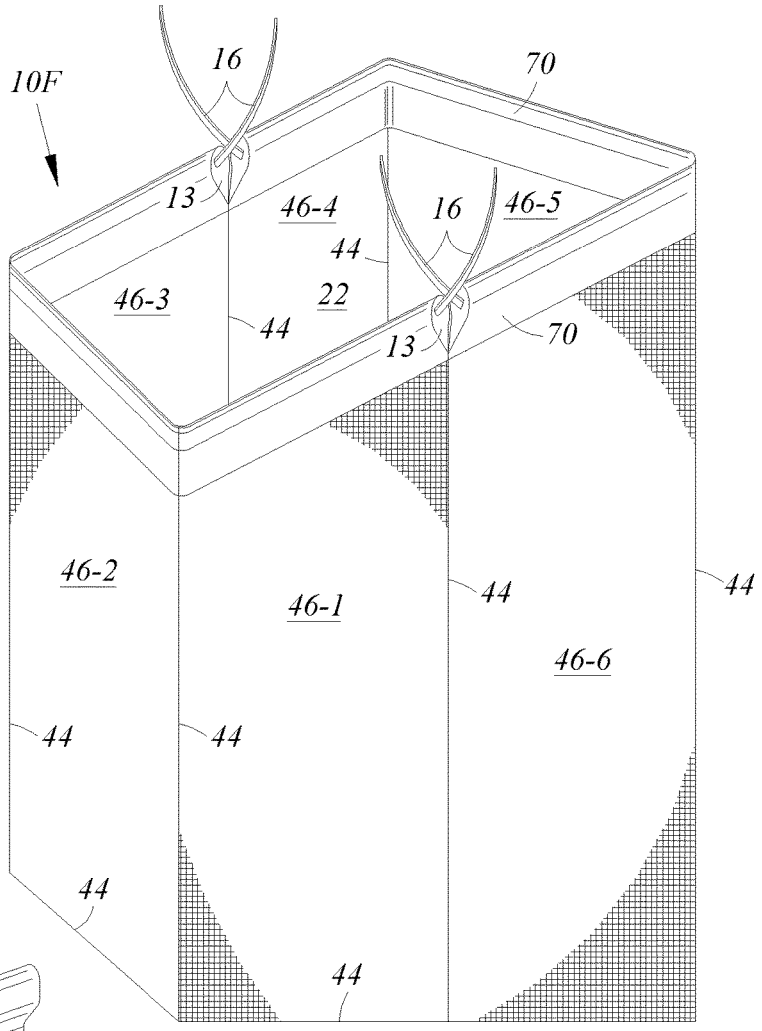
FIG. 26 is a top front perspective view of still another implementation of the fabric security bag.
Figure 27:
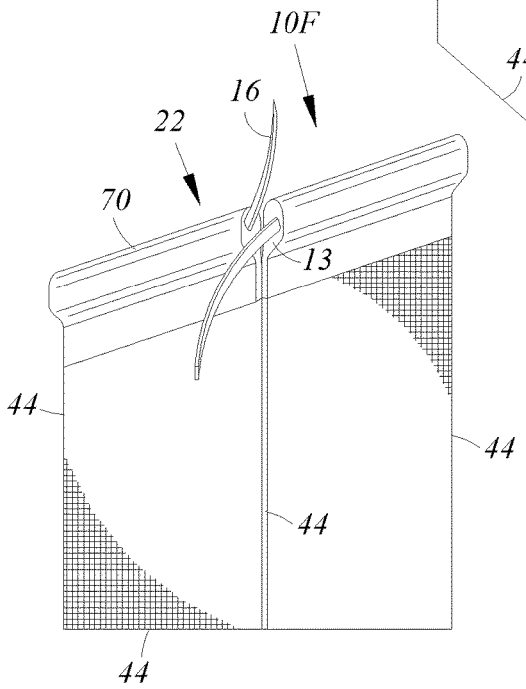
FIG. 27 is a side planar view of the implementation of the fabric security bag of FIG. 26.

Referring to FIGS. 26 and 27, a fabric security bag 10F with a rectangular horizontal cross-section is shown. The fabric security bag has six fabric panels 46-1 through 46-6 with the adjacent panels secured to each other by seams 44, such as the left vertical edge of first fabric panel 46-1 is joined to the right vertical edge of the second fabric panel 46-2 alone seam 44, and the left vertical edge of the second fabric panel 46-2 is joined to right vertical edge of the third fabric panel 46-3 along seam 44, and so on. The panels' seams are sewn, stapled, riveted, and/or adhesively bonded. Each of the six fabric panels has a toothed cable channel housing at the top of the fabric security bag which is hidden by exterior cover 70. The fabric security bag 10F could be fabricated with less than six or more than six fabric panels depending upon the size of the fabric security bag. The toothed design of the cable channel housing is hidden. The toothed design can be hidden by the fabric layer 104 (see FIGS. 4, 8 and 9), as described above. Alternatively, the toothed design of the cable channel housing can be hidden by the exterior fabric cover 70 as discussed above. The fabric security bag can be fabricated without the exterior fabric cover 70 in which case the toothed cable channel housings would be exposed like the cable channel housings of the fabric security bags of FIGS. 10-16.

Still referring to FIGS. 26 and 27, a first cable 16 runs from the entry 13 of the cable channel of the first fabric panel 46-1 and through the cable channels of each of the next two fabric panels 46-2 and 46-3 and out the entry 13 of the cable channel of the third fabric pane 46-3. A second cable 16 runs from the entry 13 of the fourth cable channel of the fourth fabric panel 46-4 and through the cable channels of each of the next two fabric panels 46-5 and 46-6 and out the entry 13 of the cable channel of the sixth fabric panel 46-6. The entries 13 of the first and sixth fabric panels are adjacent one another and the entries 13 of the third and fourth fabric panels are adjacent one another. The fabric security bag 10F of FIG. 26 only has single entries 13 for the cable channels of the first, third, fourth and sixth fabric panel. However the fabric security bag can have two entries 13 for the cable channel of each fabric panel as the fabric panels of the fabric security bags shown in FIGS. 10-16 and 25. The fabric security bag can also have a one or more cables running through the cable channels of all six fabric panels with the cable[s] ends exiting out of the cable channels at entries 13 of the cable channels of the first and sixth fabric panels 46-1 and 46-6, one or more cables can run through the cable channels of all six fabric panels with the cables ends exiting out of the cable channels at entries 13 of the cable channels of the third and fourth fabric panels 46-3 and 46-4. The fabric security bag 10F can also have more than two cables and the ends of the cables can exit the cable channels at the same and/or different entries 13 depending upon the number of cables and the number of entries.

Still referring to the fabric security bag 10F of FIGS. 26 and 27, the bottom of the fabric security bag is closed off with a rectangular shaped sheet[s] of the same fabric as used for the fabric panels (not shown). The outer edge of the rectangular shaped sheet[s] is secured to the bottom edge of the six fabric panels of the fabric security bag by sewn, stapled, riveted, and/or adhesively bonded seams (not shown).

Still referring to FIGS. 26 and 27, most fabric security bags fabricated from two or more fabric panels employ like size fabric panels and the opening of the fabric security bag at the top is parallel to the bottom fabric panel of the fabric security bag, that is the horizontal plane of the fabric security bag opening is parallel to the horizontal plane of the bottom fabric panel of the fabric security bag. However, fabric security bags can be fabricated where the opening of the fabric security bag and/or the bottom of the fabric security bag is angled and the opening of the fabric security bag and the bottom fabric panel is not parallel. The opening 22 of the fabric security bag 10F is at an angle with respect to the bottom panel of the fabric security bag (see FIG. 27). Thus the top edges of panels 46-1, 46-3, 46-4 and 46-6 are at angle with respect to the bottom edges of these panels. The top and bottom edges of the end panels 46-2 and 46-5 are parallel for this fabric security bag. All the fabric security bags disclosed herein can have angled top openings and/or angled bottom fabric panels.

Figure 28:
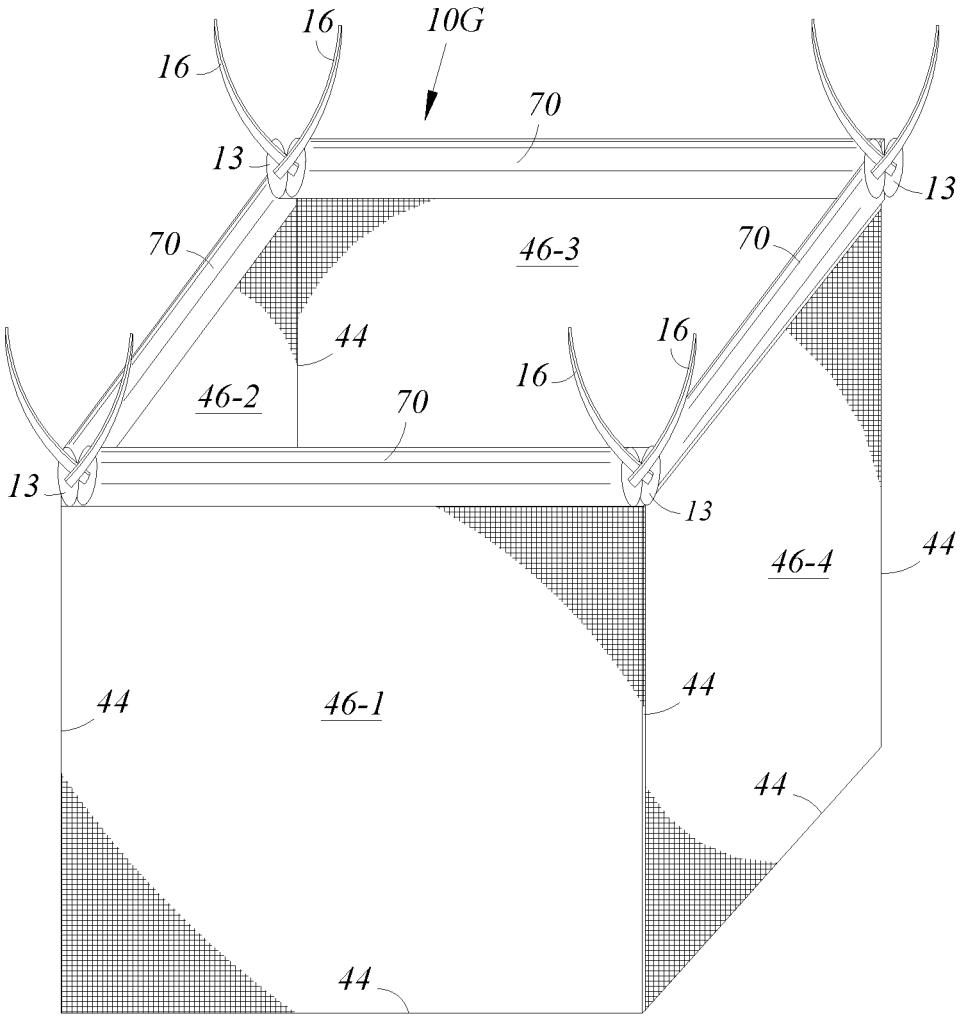
FIG. 28 is a top front perspective view of another implementation of the fabric security bag.

Referring to FIG. 28, another implementation of a fabric security bag is shown. Bag 10G has a square horizontal cross-section. The fabric security bag has four fabric panel sides 46-1 through 46-4 with the adjacent panel sides secured to each other by seams 44, such as the left vertical edge of first fabric panel side 46-1 is joined to the right vertical edge of the second fabric panel side 46-2 along seam 44, and the left vertical edge of the second fabric panel side 46-2 is joined to right vertical edge of the third fabric panel side 46-3 along seam 44 and so on. The seams 44 are sewn, stapled, riveted and/or adhesively bonded. Each of the fabric panels of the four sides has a toothed cable channel housing at the top of the fabric security bag. The toothed design of the cable channel housings is hidden. The toothed design can be hidden by the fabric layer 104 (see FIGS. 4, 8 and 9) as described above. Alternatively, the toothed design of the cable channel housing can be hidden by the exterior fabric cover 70 as discussed above. The fabric security bag 10G has four cables 16, a separate cable for the cable channel of each fabric panel side. In this fabric security bag 10G each cable only runs through a single cable channel, that is, it each cable runs only through the cable channel of a single fabric panel side. One end of each cable exits the first opening 13 of the cable channel and the second end of each cable exits the second opening of the same cable channel.

Still referring to FIG. 28, although this fabric security bag 10G has four cables with a pair of adjacent cable entries 13 at each corner, the fabric security bag can have one or more cables, as well as one or more pairs of adjacent cable entries 13. If the fabric security bag has a single cable, the single cable would run through all four of the cable channels of the four fabric panel sides and the first end of the cable would exit the cable channel entry of a fabric panel side, such as side 46-1, and the second end of the cable would exit the cable channel entry of the cable channel of the adjacent fabric panel side which in this example would be side 46-4. Dual cables could run the same way as a single cable where the ends of both cables would exit out the same cable channel entries. Alternatively, if twin cables are used, the ends of the first cable could exit adjacent entries of the cable channels of adjacent sides, such as sides 46-1 and 46-2, and the ends of the second cable could exit a different set of adjacent entries of the cable channels of adjacent sides, such as sides 46-3 and 46-4. The bottom of the fabric security bag is fabricated from one or more fabric panels (not shown). The bottom edge of each fabric panel side is joined to the corresponding edge of the fabric panel[s] on the bottom side of the fabric security bag by a sewed, stapled, riveted, and/or adhesively bonded seams. The fabric security bag 10G is shown with fabric panels made from a single sheet of heavy fabric laminate. The fabric security bag could be fabricated with one or more fabric sheets depending upon the size of the fabric security bag.

1.4 Fabric Security Bag With A Removable Outer Sleeve

The fabric security bag implementations described up to this point have an outer layer made of a light to medium protective material. This outer layer is designed to protect the heavy inner layer or layers from moisture and dirt that will be encountered when the fabric security bag is in employed for its intended purpose (as described previously). Over time, however, the outer protective layer of the fabric security bag will become soiled and/or damaged from use. Since the outer layer is integrated into to the fabric laminate making up the fabric security bag, it cannot be replaced, and the bag may become unsightly. This aesthetic shortfall is overcome using an implementation of the fabric security bag having a removable outer sleeve.

Figure 30:
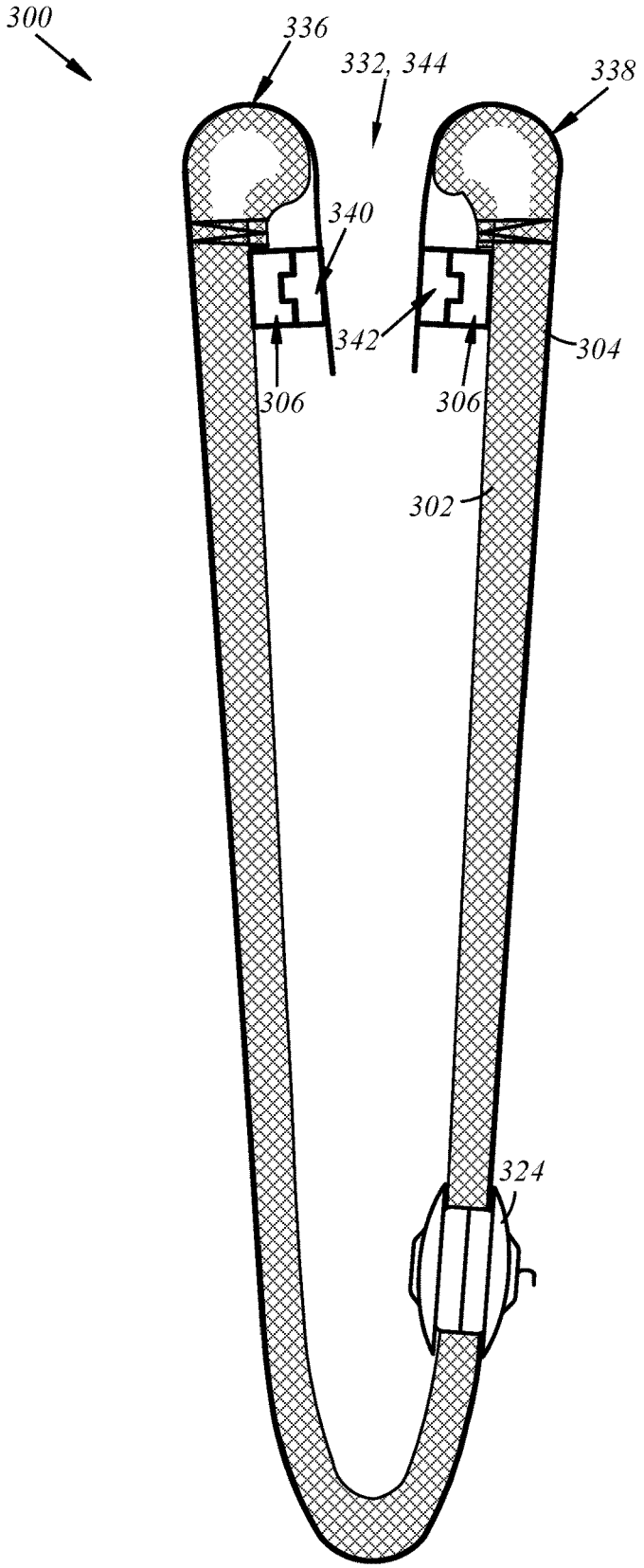
FIG. 30 is a partial cross-sectional side view of an exemplary implementation of a fabric security bag with a removable outer sleeve.
Figure 31:
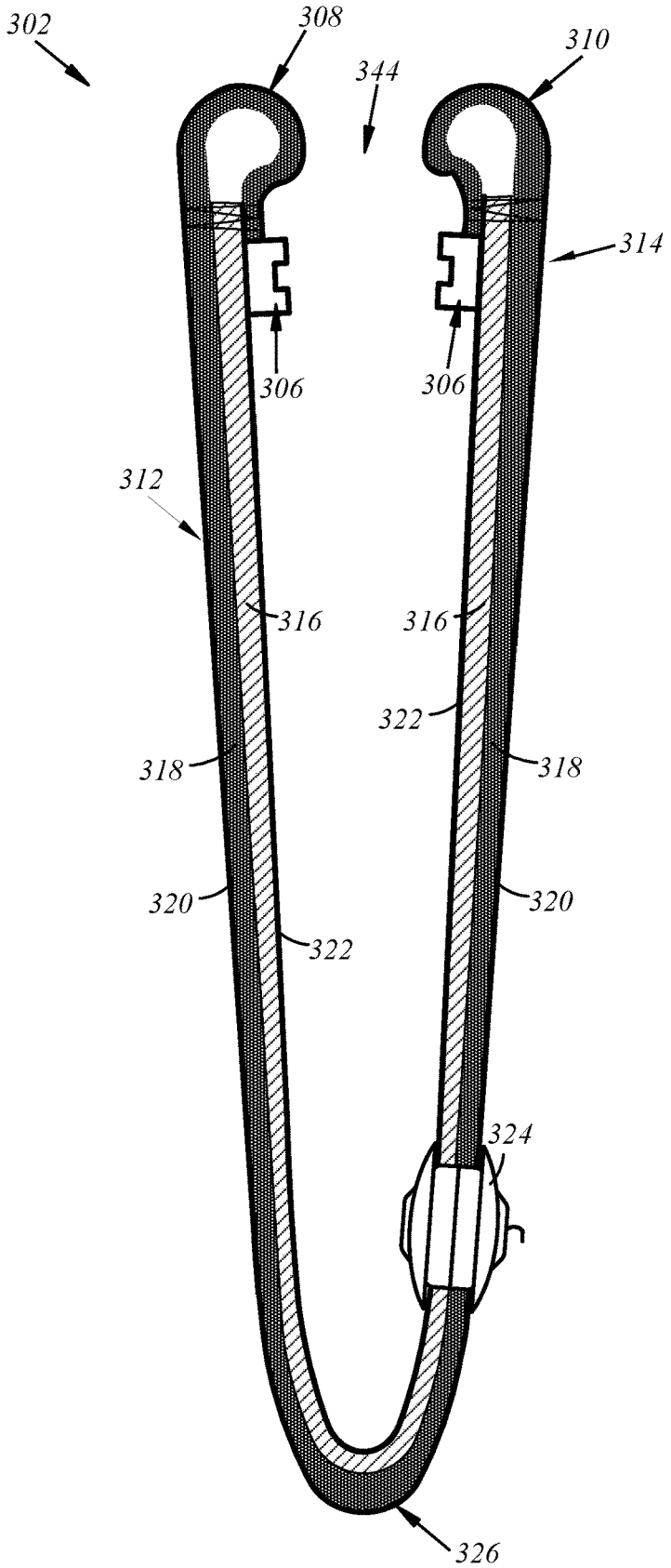
FIG. 31 is a partial cross-sectional side view of one implementation of the inner fabric security bag portion of the fabric security bag of FIG. 30.

Referring to the cross-sectional view of FIG. 30, one exemplary implementation of the fabric security bag with a removable outer sleeve 300 includes an inner fabric security bag portion 302 and a removable outer sleeve portion 304. Referring now to FIG. 31, the inner fabric security bag portion 302 is similar in construction to the fabric security bag implementation illustrated in FIGS. 10-16 with an additional feature. Namely, in one implementation, the connector(s) 306 are included just below the cable channel housing 308, 310 on the inside wall of both the front and back panels 312, 314 of the inner fabric security bag 302. However, in other implementations, the connector(s) can be located further down the inside wall of the front and back panels of the inner fabric security bag, or located on the exterior surface of the cable channel housing that faces the interior of the inner bag. In yet another implementation, the connector(s) can be located on the exterior surface of the front and back panels of the inner fabric security bag for reasons that will be described in more detail shortly. In various versions, the connectors can take the form of a connective strip that runs from the first edge side to the second edge side just under the cable channel housings, or a row of individual connectors that runs from the first edge side to the second edge side, again just under the cable channel housings. The connectors can be of the type that reside on just one surface of a pair of surfaces being removable joined together. For example, a reusable adhesive-type connector would qualify. It is noted that as will be described shortly, the removable outer sleeve can have corresponding connector[s]. If the type of connectors used are the type that resides on just one surface, then in one implementation, the inner fabric security bag portion would not have any connectors and the outer sleeve would have the connectors. Alternately, each connector can be of the type that is one-half of a pair of detachable interfacing connectors. For example, snaps or hook and loop connectors would qualify.

Still referring to FIG. 31, in one implementation of the fabric security bag with a removable outer sleeve, the inner fabric security bag's front and back panels 312, 314 have four layers of fabric laminate. More particularly, the front and back panels 312, 314 have two layers 316, 318 of heavy cut-resistant fabric forming an intermediate wall of the inner fabric security bag, a layer 320 of a protective fabric that is lighter than the cut-resistant fabric layers and which forms an exterior wall of the fabric security bag, and a layer 322 of a protective fabric that is lighter than the cut-resistant fabric layers and which forms an interior wall of the fabric security bag. Thus, this implementation represents an inner cut-resistant fabric security bag. It is noted that because the fabric security bag with a removable outer sleeve implementations have a removable outer sleeve (which will be described in more detail shortly) that provides external protection, the exterior wall of the front and back panels of the inner fabric security bag portion does not have to provide the same degree of protection as the outer sleeve. Thus, the material used to make the exterior walls of these panels can be a lighter material than the outer sleeve.

Further, the front and back panel cable channel housings 308, 310 of the inner fabric security bag portion are formed in any of the ways previously described herein, using a single layer of heavy cut-resistant fabric to form an inner wall of the housings and a protective fabric that is lighter than the cut-resistant fabric to form an exterior wall of the housings. In the version illustrated in FIG. 31, the inner walls of the housings 308, 310 are folded over extensions of the exterior-most layer 318 of cut-resistant fabric making up the intermediate wall of the front and back panels, and the exterior walls of the housings are folded over extensions of the layer 320 of the fabric making up the exterior wall of the front and back panels of the housings. It is noted that in this implementation and in implementations of the fabric security bag described previously that have more than two layers of material making up their front and back panels, a method of folding over extensions of one or more (but less than all) of the layers making up the panels of the bag to form the cable channel housings can be employed. Alternately, instead of using extensions of the front and back panels, a separate cable channel housing having a single layer of heavy cut-resistant fabric to form an inner wall of the housings and a protective fabric that is lighter than the cut-resistant fabric to form an exterior wall of the housing, can be attached in any manner described previously to the top of the front and back panels.

Implementations of the fabric security bag with a removable outer sleeve can also include cable hooks 324 (similar to the implementations depicted in FIGS. 12-16) on the back panel 314 of the inner fabric security bag portion 302. More particularly, one, two, three or more cable hooks 324 can be included along the bottom edge (or anywhere else) of the back panel of the bag 326. In one version, each cable hook is installed in a hole (not shown) through the back panel of the inner fabric security bag portion and has a two-part construction with an interior part and an exterior part which bridge and seal the hole. Alternately, the cable hook can be of a design that attaches to the exterior surface of the back panel of the bag, and so no hole is needed. Still further, in one implementation, cable hooks are not employed. Instead, the cable loops can be directly attached to the removable outer sleeve in a permanent or removable manner.

The removable outer sleeve is generally made of a protective fabric that is lighter than the fabric laminate of the inner fabric security bag portion, but still able to protect the inner bag portion from normal wear and tear. For example, the outer sleeve can be made of one or more layers of one or more of the following fabrics: nylon; ballistic nylon; Rip-Stop Nylon; cotton; cotton-polyester; polyester; brocade; canvas; rayon; vinyl; Dyneema brand composite fiber; microfiber; Packcloth and polyurethane fiber. Should the removable outer bag become soiled or damaged, it can be replaced at a lower cost than replacing one of the fabric security bag implementations that does not have an outer sleeve.

Figure 32:
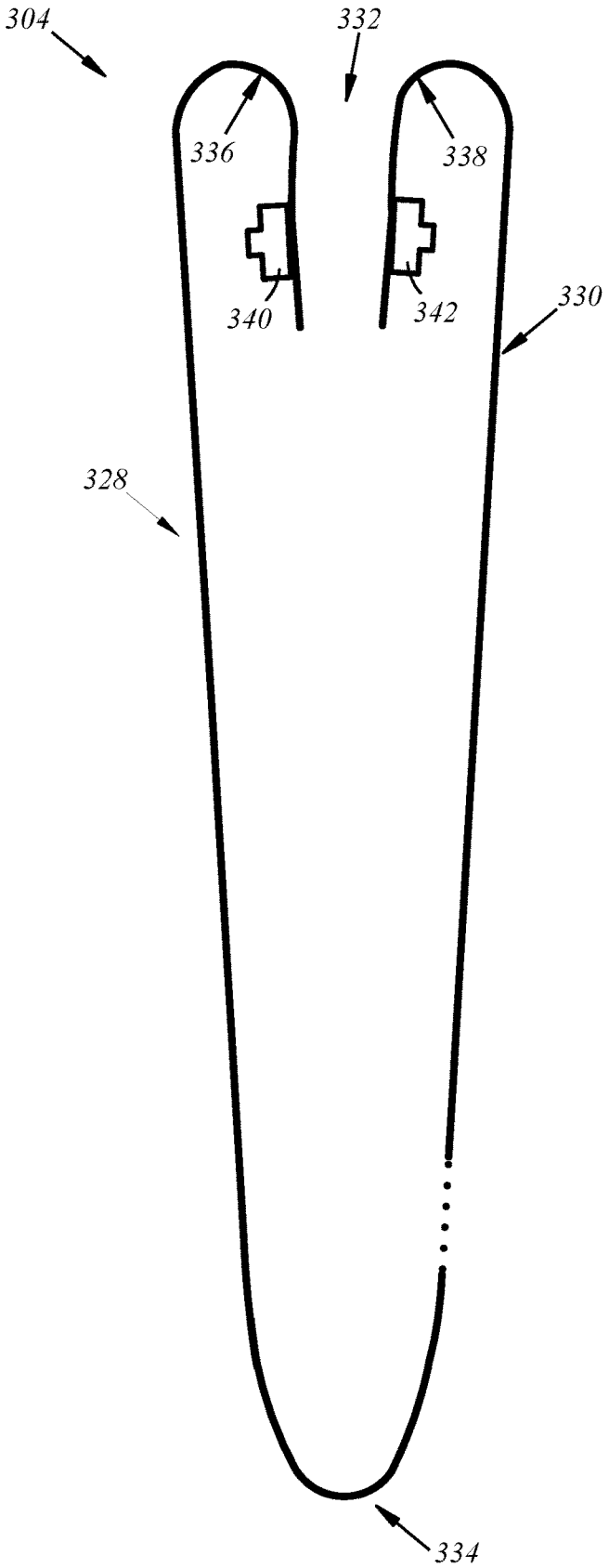
FIG. 32 is a partial cross-sectional side view of one implementation of the removable outer sleeve portion of the fabric security bag of FIG. 30.

The outer sleeve 304 is sized so that it fits over the inner fabric security bag portion 302 of the fabric security bag 300, as shown in FIG. 30. Referring now to FIG. 32, in one exemplary implementation, the removable outer sleeve 304 of the fabric security bag includes front and back panels 328, 330 which are joined along a first edge that is adjacent to an open end 332 of the outer sleeve. More particularly, the joined first edge runs from a closed end 334 of the outer sleeve 304 that is opposite its open end 332 to a flap portion 336 (best seen in FIG. 33) of the front panel 328 and a flap portion 338 (best seen in FIG. 33) of the back panel 330 which are not joined. The front and back panels 328, 330 are also joined along a second edge that is adjacent to the open end of the outer sleeve and opposite the first edge. The joined second edge runs from the closed end 334 of the outer sleeve to the flap portions 336, 338 of the front and back panels 328, 330. It is noted that in one implementation where the previously described connector(s) are located on the exterior surface of the front and back panels of the inner fabric security bag, the flaps of the outer sleeve may be joined along their first and second edges as they will not need to fold over the top of the inner bag as is the case with other implementations that will be described in more detail hereafter. In this alternate connection configuration, the inner bag is inserted into the outer sleeve and the connector(s) on the interior surface of the outer sleeve are connected to the corresponding connectors on the exterior surface of the inner fabric security bag. In one implementation, the front and back panels are also joined at the closed end of the outer sleeve. Alternatively, as shown in FIG. 32, the front and back panels 328, 330 are formed from a single sheet of fabric laminate (similar to that described in connection with previous implementations of the fabric security bag). Further, in the implementation depicted in FIGS. 33 and 34, the seams of the joined edges are inside the sleeve for added security, as described previously.

Referring again to FIG. 32, in one implementation, the removable outer sleeve includes a first row of one or more connectors 340 disposed along an inner wall of the flap portion 336 of the front panel 328 of the outer sleeve 304, and a second row of one or more connectors 342 disposed along an inner wall of the flap portion 338 of the back panel 330 of the outer sleeve. In various versions, the connector(s) can take the form of a connective strip that runs from the first edge side to the second edge side of the flaps, or a row of individual connectors that runs from the first edge side to the second edge side of the flaps. In either case, the connector or connectors on the flap portions of the removable outer sleeve align with and are connectable to the connector or connectors on the inside of the inner fabric security bag. The connectors can be of the type that reside on just one surface of a pair of surfaces being removable joined together. For example, a reusable adhesive-type connector would qualify. It is noted that if the type of connectors used is the type that resides on just one surface, then in one implementation, the removable outer sleeve would not have any connectors and the inner fabric security bag would have the connectors. Alternately, each connector can be of the type that is one-half of a pair of detachable interfacing connectors. For example, snaps or hook and loop connectors would qualify.

To prepare the implementations of the fabric security bag with a removable outer sleeve for use, the inner fabric security bag portion of the fabric security bag is inserted into the removable outer sleeve such that the closable open end of the inner fabric security bag and the open end of the outer sleeve are adjacent each other, as seen in FIG. 30. The flap portion 336 of the front panel of the outer sleeve is then folded over the closable open end 344 of the inner fabric security bag 302 so that the row of one or more connectors 340 on the inner wall of this flap portion align with and are connected to the row of one or more connectors 306 on the inner wall of the front panel of the inner fabric security bag. Similarly, the flap portion 338 of the back panel of the outer sleeve is folded over the closable open end 344 of the inner fabric security bag 302 so that the row of one or more connectors 342 on the inner wall of this flap portion align with and are connected to the row of one or more connectors 306 on the inner wall of the back panel of the inner fabric security bag.

Figure 33:
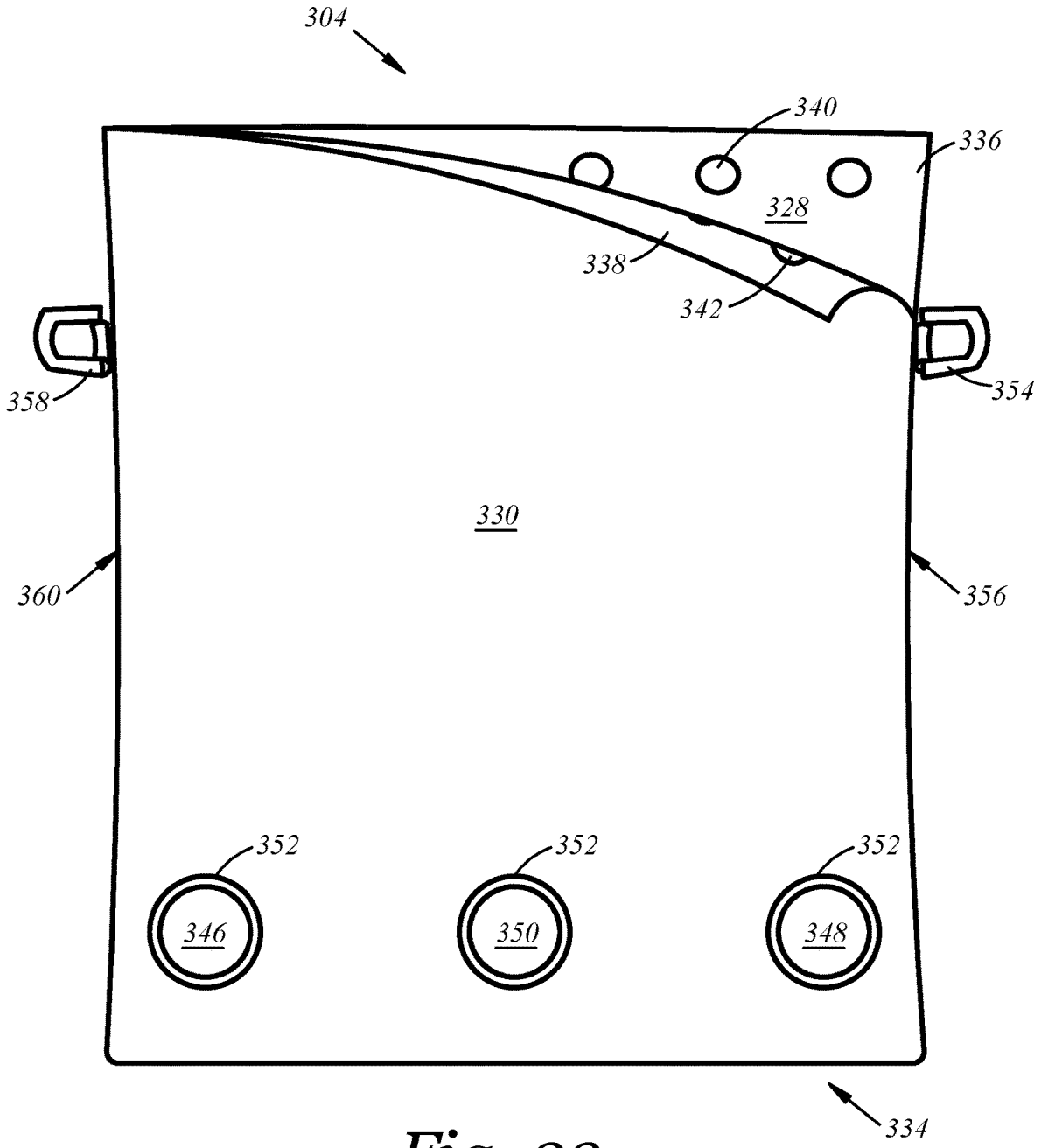
FIG. 33 is a back planar view of one implementation of the removable outer sleeve portion of the fabric security bag of FIG. 30.

Referring to FIGS. 30 and 33, for implementations of the inner fabric security bag portion 302 that include cable hooks 324, the removable outer sleeve 304 of those implementations includes a first through hole 346 in the removable outer sleeve located adjacent a first corner of the back panel 330 adjacent the closed end 334. This through hole 346 aligns with a corresponding cable hook 324 of the inner fabric security bag 302 whenever the inner bag is installed in the removable outer sleeve 304. The first through hole 346 is sized to allow the cable hook 324 to protrude through the removable outer sleeve 304. In one implementation, the first through hole 346 has a flange 352 around its periphery that interfaces with the cable hook 324 and secures the flange, and so secures the first corner portion of the back panel 330 of the removable outer sleeve 304 to the inner bag 302. A second through hole 348 in the removable outer sleeve 304 can also be included. This second through hole 348 is located adjacent a second corner of the back panel 330 adjacent the closed end 334. The second through hole 348 aligns with a corresponding cable hook 324 of the inner fabric security bag 302 whenever the inner bag is installed in the removable outer sleeve 304. The second through hole 348 is also sized to allow the cable hook 324 to protrude through the removable outer sleeve 304, and in one implementation, the second through hole has a flange 352 around its periphery that interfaces with the cable hook and secures the flange, and so secures the second corner portion of the back panel 330 of the removable outer sleeve to the inner bag 302. In some implementations, a third through hole 350 in the removable outer sleeve 304 is included. This third through hole 350 is located between the first and second through holes 346, 348 and is adjacent the closed end 334 of the removable outer sleeve 304. The third through hole 350 aligns with a corresponding cable hook 324 of the inner fabric security bag 302 whenever the inner bag is installed in the removable outer sleeve 304. The third through hole 350 is also sized to allow the cable hook 324 to protrude through the removable outer sleeve 304, and in one implementation, the third through hole has a flange 352 around its periphery that interfaces with the cable hook and secures the flange and so the lower midportion of the back panel 330 of the removable outer sleeve to the inner bag 302.

Figure 34:
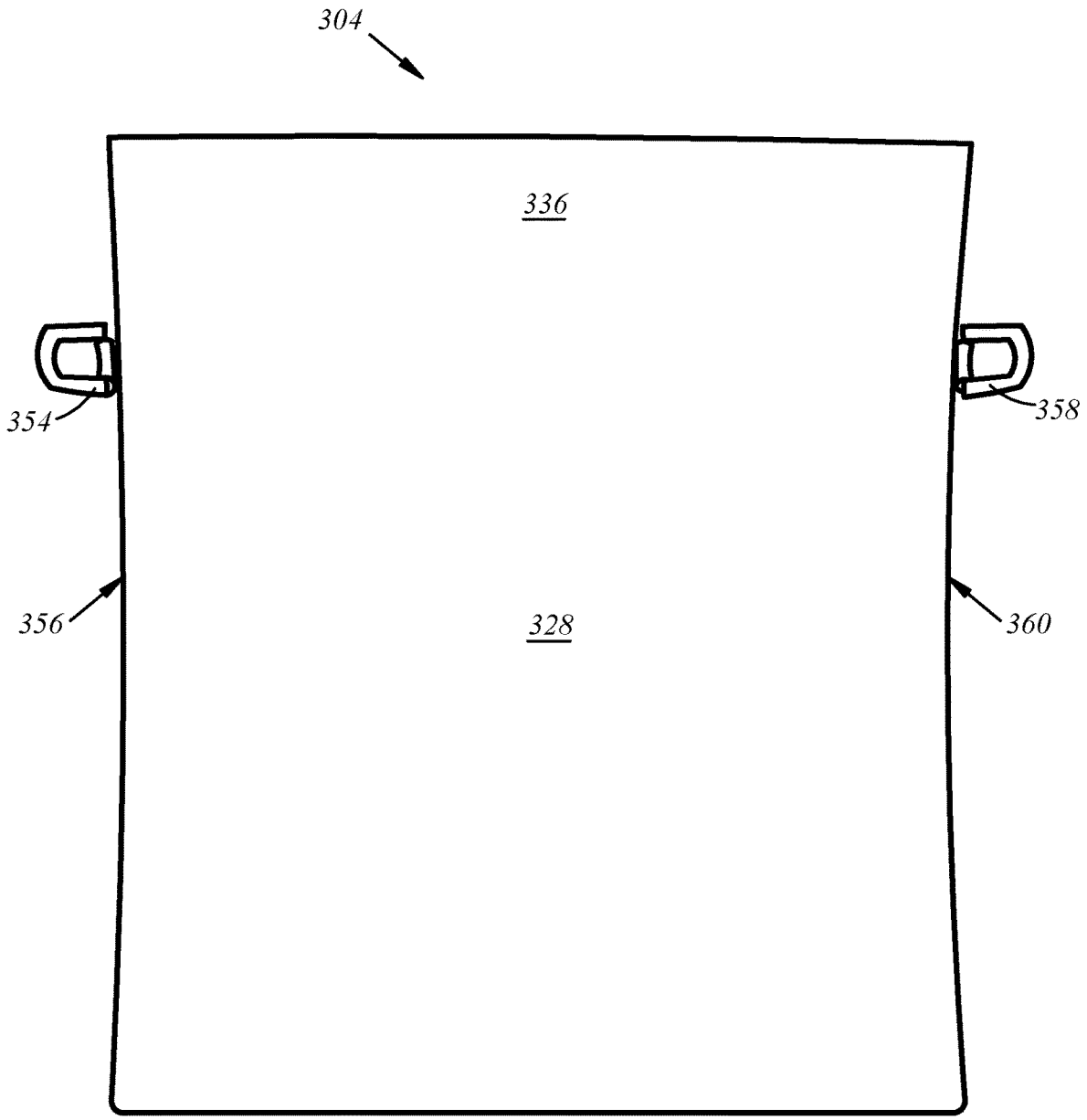
FIG. 34 is a front planar view of one implementation of the removable outer sleeve portion of the fabric security bag of FIG. 30.

Referring to FIGS. 33 and 34, one implementation of the removable outer sleeve 304 includes a first cable catch 354 attached to a first edge 356 of the sleeve adjacent the flap portions 336, 338 of the front and back panels 328, 330, and a second cable catch 358 attached to a second edge 360 of the sleeve adjacent the flap portions of the front and back panels. The cable catches 354, 358 are used to capture and hold the connected end portions of the previously described cable(s). In one version the cable or cables are attached to the cable catches 354, 358 with a carabiner type connector. If a different cable is attached to each of the cable catches 354, 358, the cables form a tote handle for the fabric security bag.

It is noted that while the foregoing description includes particular implementations of the inner fabric security bag for use with the removable outer sleeve, the previously described implementations of the fabric security bag (such as those depicted in FIGS. 10-16) could be employed as the inner fabric security bag portion and fitted into the removable outer sleeve as well.

2.0 Additional Implementations

While the fabric security bag has been described by specific reference to implementations thereof, it is understood that variations and modifications thereof can be made without departing from the true spirit and scope of the apparatus. For example, if the fabric security bag is being made from a roll or sheet of fabric laminate whose width is less than required for the width (or height) of the fabric security bag (e.g., rolls of fabric are often manufactured in 60 inch widths), multiple sheets of fabric laminate can be seamed together with thread, staples, rivets, and/or an adhesive binder as described herein to create a large overall sheet of fabric laminate to accommodate the required size needed for a large fabric security bag.

In one implementation, a roll or sheet of fabric laminate that is the desired width of the fabric security bag being constructed is employed to eliminate the need to seam one of the edges or the bottom of the bag. More particularly, in one version, the fabric laminate sheet is folded over along the width of the fabric to form the base or bottom edge of the fabric security bag. Half of the fabric sheet forms the front of the fabric security bag, and the other half of the fabric forms the back of the fabric security bag. The side edges of the fabric sheet are joined or seamed to form the side edges of the fabric security bag and the top sides of the fabric sheet are left free to form the cable channel and fabric security bag opening. The bottom of the fabric security bag is formed by the fold of the fabric sheet. The width of the fabric sheet will determine the width of the fabric security bag. Alternatively, the fabric security bag of the present invention can be made by folding a single sheet of fabric laminate with one edge of the fabric security bag being the fabric fold. In this implementation, one half of the fabric sheet forms the front of the fabric security bag, and the other half of the fabric sheet forms the back of the fabric security bag. The free sides of the fabric sheet on the side opposite the fold of the fabric sheet and the free sides of the fabric sheet on the bottom side are joined or seamed as described above. In this case, the width of the fabric laminate sheet will determine the height of the fabric security bag. In the latter implementation where the fold of the fabric laminate sheet forms one side of the fabric security bag, the cable channel of the fabric security bag can be continuous from a first side edge of the front panel of the fabric security bag, across the front panel to the a second side edge of the fabric security bag created by the fold of the fabric sheet and around the second side edge of the fabric security bag within the cable channel and across the back panel to the first side edge. In this implementation, the cable channel of the fabric security bag would have only two entries on the first side edge of the fabric security bag opposite the second side edge.

Further, to this point the implementations of the fabric security bag described herein that employ cable hooks have two or three hooks near the bottom edge of the back panel of the bag. However, in various other implementation, the cable hooks can be located anywhere in the back panel or front panels of the bag. In addition, one or more cable hooks can be employed, not just the two or three described previously. In implementations employing the previously described outer sleeve with holes that allow the cable hooks on the inner bag to protrude through the holes, the sleeve would have holes corresponding to the one or more cable hooks on the inner bag.

The foregoing description indicated that the entries in the cable housing channels that allowed one or more cables to enter or exit the housing were at the ends of the housings, typically at the ends of a panel. However, a cable housing entry can be formed anywhere along the housing channel, not just at the ends. In addition, various implementation of the cable housing can have no entries (such as when the cable housing of one panel is directly connected to the cable housing of an adjacent panel), or one or more entries, as desired.

In the foregoing description it was indicated that a fabric laminate was employed to form the front and back panels, as well as the cable housings, of the fabric security bag implementations. However, in an alternate implementation, instead of a fabric laminate, the panels and/or cable housings can be made of one of more sheets of the previously described cut-resistant or security fabric. Further, the exterior and/or interior surfaces of this alternate material can be coated with a waterproofing material to prevent water damage to items stored in the bag.

The implementations of the fabric security bag with a removable outer sleeve described previously involved a two-panel configuration. However, any of the other single or multiple panel configurations can also be adapted to include an outer sleeve by adding the previously described connectors to the fabric security bag (which becomes the inner fabric security bag). In addition, the outer sleeve is modified to match the panel configuration of the inner bag.

It is also noted that any or all of the aforementioned implementations throughout the description may be used in any combination desired to form additional hybrid implementations. In addition, although the tuning apparatus implementations have been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims. In regard to the various functions performed by the above described components and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

Wherefore, what is claimed is:

1. A fabric security bag, comprising:

a front panel and back panel which are joined along a first edge that is adjacent to a closable open end of the fabric security bag, joined along a second edge that is adjacent to the open end and opposite the first edge, and joined along a closed end that is opposite the closable open end of the fabric security bag to form a cut-resistant portion of the fabric security bag;

said front panel and back panel of the cut-resistant portion of the fabric security bag being made from a fabric laminate having two layers of cut-resistant fabric forming an intermediate wall of the fabric security bag, a layer of a protective fabric that is lighter than the cut-resistant fabric and which forms an exterior wall of the fabric security bag, and a layer of a protective fabric that is lighter than the cut-resistant fabric and which forms an interior wall of the fabric security bag;

said closable open end of the fabric security bag comprising, a first cable channel housing forming a first cable channel along an edge of the front panel of the cut-resistant portion of the fabric security bag at the open end thereof and a second cable channel housing forming a second cable channel along an edge of the back panel of the cut-resistant portion of the fabric security bag at the open end thereof, said first and second cable channel housings being made from a fabric laminate having a layer of cut-resistant fabric forming an inner wall of the housings and a layer of a protective fabric that is lighter than the cut-resistant fabric and which forms an exterior wall of the housings, and wherein the layer of cut-resistant fabric forming the inner wall of the housings comprises cut-out sections where the cut resistant fabric has been removed to form a tooth pattern along the housings to reduce the amount of fabric making up the housings, a first cable, a portion of which is threaded through the first cable channel and another portion of which is threaded through the second cable channel, and first and second end portions of which extend out of the first and second cable channels, respectively, on the same side of the closable open end of the fabric security bag, said first cable being slidable within the first and second cable channel housings that form the first and second cable channels, and a second cable, a portion of which is threaded through the first cable channel and another portion of which is threaded through the second cable channel, and first and second end portions of which extend out of the first and second cable channels, respectively, on the same side of the closable open end of the fabric security bag which is opposite the side of the closable open end that the first and second end portions of the first cable extend out of the first and second cable channels, said second cable being slidable within the first and second cable channel housings that form the first and second cable channels, and wherein whenever both ends portions of the first and second cables are drawn out of the first and second cable channels at the same time, the fabric laminate forming the first and second cable housing of the closable open end of the fabric security bag is collapsed in a manner facilitated by the cut-out sections in the first and second cable channel housings to reduce the size of the open end and close the fabric security bag, thereby securing items placed inside the fabric security bag that are larger than the closed open end from exiting the fabric security bag; and a removable outer sleeve comprising a front panel and back panel which are joined along a first edge that is adjacent to an open end of the outer sleeve from a closed end that is opposite the open end of the outer sleeve to a flap portion of the front panel and a flap portion of the back panel which are not joined and which form the open end of the outer sleeve, joined along a second edge that is adjacent to the open end and opposite the first edge from the closed end to the flap portion of the front panel and the flap portion of the back panel, and joined along the closed end that is opposite the open end of the outer sleeve, said outer sleeve being sized so that it fits over the cut-resistant portion of the fabric security bag, said front panel and back panel being made from a protective fabric that is lighter than said cut-resistant fabric, said open end of the outer sleeve further comprising, a first row of one or more connectors disposed along an inner wall of the flap portion of the front panel of the outer sleeve, and a second row of one or more connectors disposed along an inner wall of the flap portion of the back panel of the outer sleeve, and wherein the cut-resistant portion of the fabric security bag is inserted into the outer sleeve such that the closable open end of the fabric security bag and the open end of the outer sleeve are adjacent each other, and wherein, the flap portion of the front panel of the outer sleeve comprising the first row of one or more connectors on the inner wall thereof is folded over the closable open end of the fabric security bag such that the line of one or more connectors on the inner wall of the flap portion of the front panel align with and are connected to a row of one or more connectors on the inner wall of the front panel of the cut-resistant portion of the fabric security bag, and wherein, the flap portion of the back panel of the outer sleeve comprising the second row of one or more connectors on the inner wall thereof is folded over the closable open end of the fabric security bag such that the row of one or more connectors on the inner wall of the flap portion of the back panel align with and are connected to a row of one or more connectors on the inner wall of the back panel of the cut-resistant portion of the fabric security bag.

2. The fabric security bag of claim 1, further comprising backpack features comprising:

a first cable connector that connects the first and second end portions of the first cable of the cut-resistant portion of the fabric security bag;

a second cable connector that connects the first and second end portions of the second cable of the cut-resistant portion of the fabric security bag;

a first cable hook secured to the back panel of the cut-resistant portion of the fabric security bag adjacent a first corner of the closed end of the cut-resistant portion of the fabric security bag, wherein the first cable hook is capable of capturing and holding either the connected end portions of the first or second cables;

a second cable hook secured to the back panel of the cut-resistant portion of the fabric security bag adjacent a second corner of the closed end of the cut-resistant portion of the fabric security bag that is opposite said first corner, wherein the second cable hook is capable of capturing and holding the connected end portions of the first cable whenever the first cable hook is holding the second cable or capturing and holding the connected end portions of the second cable whenever the first cable hook is holding the first cable;

a first through hole in the removable outer sleeve located adjacent a first corner of the back panel adjacent the closed end of the removable outer sleeve and aligned with the first cable hook of the cut-resistant portion of the fabric security bag whenever the cut-resistant portion of the fabric security bag is installed in the removable outer sleeve, said first through hole having a size that allows the first cable hook of the cut-resistant portion of the fabric security bag to protrude through and be secured in place by the removable outer sleeve; and a second through hole in the removable outer sleeve located adjacent a second corner of the back panel adjacent the closed end of the removable outer sleeve and aligned with the second cable hook of the cut-resistant portion of the fabric security bag whenever the cut-resistant portion of the fabric security bag is installed in the removable outer sleeve, said second through hole having a size that allows the second cable hook of the cut-resistant portion of the fabric security bag to protrude through and be secured in place by the removable outer sleeve.

3. The fabric security bag of claim 1, further comprising tote handle features comprising:

a first cable connector that connects the first and second end portions of the first cable of the cut-resistant portion of the fabric security bag;

a second cable connector that connects the first and second end portions of the second cable of the cut-resistant portion of the fabric security bag;

a first cable catch attached to a first edge of the removable outer sleeve adjacent the flap portions of the front and back panels, wherein the first cable catch is capable of capturing and holding the connected end portions of the second cable; and a second cable catch attached to a second edge of the removable outer sleeve adjacent the flap portions of the front and back panels, wherein the second cable catch is capable of capturing and holding the connected end portions of the first, and wherein;

whenever the connected end portions of the second cable are held by the first cable catch and the connected end portions of the first cable are held by the second cable catch, the first and second cable form a tote handle for the fabric security bag.

* * * * *